United States Patent [19]

von Konig et al.

[11] 3,933,507

[45] Jan. 20, 1976

[54] PHOTOGRAPHIC LIGHT-SENSITIVE AND HEAT DEVELOPABLE MATERIAL

[75] Inventors: Anita von Konig, Leverkusen; Helmut Kampfer, Cologne, both of Germany; Eric Maria Brinckmann, Mortsel; Frans Clement Heugebaert, Kontich, both of Belgium

[73] Assignee: AGFA-Gevaert, A.G., Leverkusen-Bayerwerk, Germany

[22] Filed: Aug. 10, 1972

[21] Appl. No.: 279,523

[30] Foreign Application Priority Data

Aug. 12, 1971 Germany ..... 2140462

[52] U.S. Cl. ..... 96/114.1; 96/67; 96/114.6; 96/120; 96/127; 96/129; 96/137; 96/139; 96/140

[51] Int. Cl.[2] ..... G03C 1/02

[58] Field of Search ..... 96/114.1, 67, 127, 137, 96/139, 140

[56] References Cited

UNITED STATES PATENTS

| | | | |
|---|---|---|---|
| 3,152,904 | 10/1964 | Sorensen et al. | 96/114.1 |
| 3,457,075 | 7/1969 | Morgan et al. | 96/114.1 |
| 3,685,993 | 8/1972 | Mukherjee | 96/114.1 |
| 3,700,457 | 10/1972 | Youngquist | 96/114.1 |
| 3,761,279 | 9/1973 | de Mauriac et al. | 96/114.1 |
| 3,770,448 | 11/1973 | Poot et al. | 96/114.1 |
| 3,844,797 | 10/1974 | Willems et al. | 96/114.1 |

*Primary Examiner*—J. Travis Brown
*Attorney, Agent, or Firm*—Connolly and Hutz

[57] ABSTRACT

Heat developable light-sensitive photographic material having a layer which contains a light-sensitive combination of a silver compound substantially insensitive to light, a reducing agent for that silver compound and a polymethine sensitizer. The exposed material is heated so that the silver compound in the exposed areas is reduced and a visible silver image is formed.

14 Claims, No Drawings

PHOTOGRAPHIC LIGHT-SENSITIVE AND HEAT DEVELOPABLE MATERIAL

The invention relates to a single or multi-layer photographic recording material which contains a light-insensitive silver salt, one or more sensitizing dyes and a reducing agent which is capable of reducing the silver salt on heating the image being recorded by development of the material by heat after imagewise exposure.

The light-sensitive compounds used in known conventional photographic materials are silver halides which are sensitive to the longwave ultraviolet or blue region of the spectrum and which can be sensitized to other regions of the visible spectrum, up to wavelengths of 1 $\mu$u, by means of spectral sensitizing dyes. The spectral sensitivity of these conventional materials is therefore composed of the inherent sensitivity of the silver halides and the sensitivity due to the sensitizing dyes. This has the serious disadvantage, e.g. in the case of color photographic materials, that it is necessary to protect certain layers, such as those which have been sensitized to green and red, against light in the range of their inherent sensitivity by the interposition of filter layers. Another disadvantage of conventional materials is that excess silver halide which is not reduced during development must be removed by a subsequent fixing process or stabilized by conversion into a light-stable complex ground.

The conventional recording processes have been modified in various ways, always with the object of simplifying the process as much as possible. These modifications include the heat development process described in German Pat. Specification No. 888,045.

In this process, light-sensitive silver halide layers which contain developer are developed in the heat without aqueous developer baths after they have been exposed to light. Compounds which have been described as developers incorporated in silver halide layers which can be developed by heat are derivatives of hydroquinone, pyrocatechol, aminophenol, phenylenediamine, pyrazolidone-(3) and of 8-hydroxyquinoline. Silver halide layers of this kind which can be developed by heat must be fixed or stabilized to prevent substantial discoloration of the background of the image upon exposure.

Completely dry processes which can be carried out without using treatment baths have also become known. These include all thermographic copying processes, e.g. the process described in German Auslegeschrift No. 1,193,971. In this process, a heat sensitive layer is used which contains a noble metal salt of an organic acid and a reducing agent for the noble metal salt, the image being obtained by the reduction to free metal which occurs on imagewise exposure to heat. The salts and reducing agents used are preferably silver salts of long chain organic fatty acids and cyclic organic reducing agents which contain an active hydrogen atom attached to O, N or C. Layers of this kind are, however, not sensitive to visible light.

The recording materials used in the process described in German Pat. Specification No. 1,300,014 contain an oxidizing agent, a reducing agent and a minor quantity of a light-sensitive compound which on exposure to radiation gives rise to photolytic products which, when the material is subsequently heated, initiate the Redox reaction which is accompanied by the formation of color. The oxidizing agents used are organic silver salts and the reducing agents are aminophenols, hydroxylamines, pyrazolidones or phenols. Phenylenediamine and etherified naphthols such as 4-methoxynaphthol-1- have also been described for this purpose. The light-sensitive compounds used may be heavy metal salts which form traces of free metal on exposure, particularly light-sensitive silver salts such as silver halides which decompose photolytically, on exposure, to form metallic silver. These photolytic heavy metal nuclei initiate the Redox reaction.

For the practical application of these materials it is essential to use as oxidizing agents silver salts which are insensitive to light, e.g. silver saccharide or the silver salts of long chain fatty acids. High sensitivity to light is obtained if the required silver halide is produced on the surface of the light-insensitive silver salt by providing a supply of halide ions or of a compound which forms halide ions, as described in German Offenlegungsschrift No. 1,572,203. These materials have a sensitivity in the short wave region of the visible spectrum which corresponds to the inherent sensitivity of the silver halides used and can also be sensitized to light of longer wavelength by the addition of spectral sensitizing dyes.

The known processes constitute dry processes by which it is possible to produce photographic images which differ in quality according to the particular process employed, but with these materials it was not possible to obviate the disadvantage mentioned above that the inherent or natural sensitivity of the light-sensitive heavy metal salt exists in addition to the desired spectral sensitivity produced by the sensitizing dyes.

It is among the objects of the present invention to provide a photographic material which, while being simple to prepare and suitable for dry processing, is sensitive only in specified regions of the spectrum.

We now have found a process of producing photographic copies by a dry process which comprises exposing a supported photographic layer which contains a silver salt which is substantially insensitive to light under the conditions of the process, a reducing agent for this silver salt and a polymethine sensitizer for spectrally sensitizing the light insensitive silver compound and heating the exposed material to a temperature at which the reducing agent reduces the silver compound in the exposed areas to form a visible silver image.

A further subject of the present invention is photographic material for performing the above process.

It has hitherto been held in the art that in order to achieve spectral sensitization it was essential that the silver salt which was to be sensitized should have an inherent sensitivity which could be photographically utilized. This invention, however, is based on the unexpected effect that silver compounds which are insensitive to light and sensitizers which are also insensitive to light together constitute a combination which is sensitive to light even without the addition of catalytic quantities of light-sensitive heavy metal salts.

A special advantage of this combination is that owing to the absence of a natural sensitivity of the silver compound, sensitivity to light occurs only in the effective spectral range of the sensitizer. The spectral sensitivity of the combination therefore depends entirely on the chemical constitution and effective range of the sensitizer.

Numerous polymethine dyes whose effect on light-sensitive silver halide-gelatin emulsions is already known are suitable for this invention. Polymethine sensitizers of the following formulae have been found to be particularly suitable:

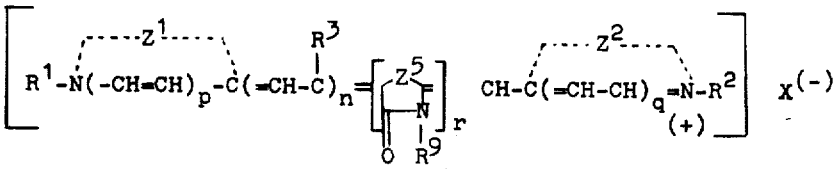

I

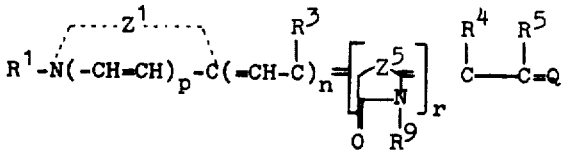

II

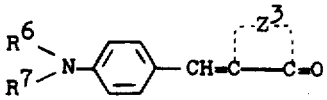

III

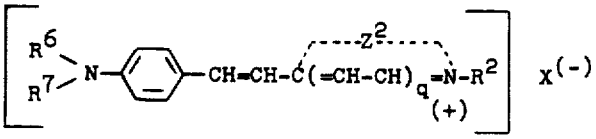

IV

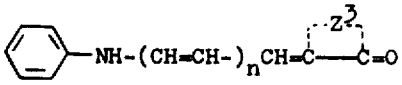

V

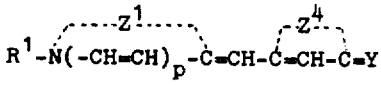

VI wherein $R^1$, $R^2$ represent (1) a saturated or unsaturated aliphatic group which preferably contains up to 18 carbon atoms and which may be substituted, e.g. with a halogen, phenyl, hydroxy, carboxyl, sulfo, sulfamoyl, carbamoyl, alkoxycarbonyl, alkoxy, carboxyalkyl, sulfato or thiosulfato or N-acylsulfamoyl group; (2) cycloalkyl such as cyclohexyl or cyclopentyl; (3) aryl, particularly a phenyl group or (4) alkoxy, preferably methoxy;

$R^3$ represents hydrogen, phenyl or a saturated aliphatic group which preferably contains up to 3 carbon atoms;

$R^4$ represents hydrogen, cyano, $-CO-R^8$, $$-CO-N\begin{matrix}R^6\\R^9\end{matrix}$$

or $-COOR^8$;

$R^5$ stands for $R^8$, $-OR^8$, $$N\begin{matrix}R^6\\R^9\end{matrix}$$

or $-N(CH_2)_m$; or $R^4$ and $R^5$ represent together the ring members required for completing an isocyclic or heterocyclic ketomethylene ring which may be any of the rings commonly used in cyanine chemistry, for example, those based on rhodanine (such as 3-ethyl-rhodanine, 3-allyl-rhodanine or 3-cyclohexyl-rhodanine); 2-thio-2,4-oxazolidine dione (such as 3-ethyl-2-thio-2,4-oxazolidine dione); thiohydantoin (such as 1,3-dimethyl-2-thiohydantoin or 1-methyl-3-phenyl-2-thiohydantoin); barbituric acid or thiobarbituric acid (such as 1,3-diethyl-thiobarbituric acid or 1,3-diphenyl-thiobarbituric acid); isoxazolone, oxindole, 2-thio-2,5-thiazolidine dione, 2,4-imidazolidine dione or 1,3-indan-dione;

$R^6$, $R^7$ represent hydrogen or $R^8$;

$R^8$ stands for a saturated or olefinically unsaturated aliphatic group which preferably contains up to 6 carbon atoms and which may be substituted, e.g. with phenyl, hydroxyl, halogen (such as chlorine or bromine), amino, carboxyl, sulfo or aryl (such as phenyl or naphthyl);

$X^{(-)}$ represents any anion, e.g. perchlorate, sulfate, methylsulfate, p-toluene sulfonate or the like. The anion is absent in cases where $R^1$ or $R^2$ contains an acid group in the anionic form so that a betaine is present;

$m = 4,5,6$;

$n = 0, 1, 2$;

$r,p,q = 0$ or 1;

Q = O or S;

$R^9$ stands for hydrogen, $R^8$ or aryl such as phenyl or naphthyl;

$Z^1$, $Z^2$ represent the members required for completing a 5- or 6-membered heterocyclic ring; the heterocyclic group may contain a condensed benzene or naphthalene ring and further substituents. The heterocyclic groups may be those common in cyanine chemistry, for example those based on thiazole (e.g. thiazole, 4-methyl-thiazole, 5-methylthiazole, 4,5-dimethyl-thiazole, 4-phenyl-thiazole, 5-phenyl-thiazole or 4,5-diphenylthiazole); benzothiazole (e.g. benzothiazole, 4-chloro-benzothiazole, 5-chloro-benzothiazole, 6-chloro-benzothiazole, 7-chloro-benzothiazole, 6-bromo-benzothiazole, 5-iodo-benzothiazole, 6-iodo-benzothiazole, 4-methyl-benzothiazole, 5-methyl-benzothiazole, 6-methyl-benzothiazole, 5,6-dimethylbenzothiazole, 4-phenyl-benzothiazole, 5-phenylbenzothiazole, 6-phenyl-benzothiazole, 5-hydroxybenzothiazole, 6-hydroxy-benzothiazole, 4-methoxy-benzothiazole, 5-methoxy-benzothiazole, 6-methoxy-benzothiazole, 5-ethoxy-benzothiazole, 6-ethoxy-benzothiazole, 5,6-dimethoxy-benzothiazole, 5,6-methylene-dihydroxy-benzothiazole, 5-diethyl-amino-benzothiazole, 5-diethyl-aminonbenzothiazole, 6-diethyl-amino-benzothiazole, 5-carboxy-benzothiazole, 5-sulfo-benzothiazole, tetrahydro-benzothiazole or 7-oxo-tetrahydro-benzothiazole); naphthothiazole (e.g. naphtho[1,2-d]thiazole, naphtho[2,1-d]thiazole, 5-methoxynaphtho[2,1-d]thiazole, 5-ethoxynaphtho[2,1-d]thiazole, 7-methoxynaphtho[2,1-d]thiazole, or 8-methoxynaphtho[1,2-d]thiazole); selenazole (e.g. 4-methylselenazole or 4-phenylselenazole); benzoselenazole (e.g. benzoselenazole, 5-chlorobenzoselenazole, 5,6-dimethyl-benzoselenazole or tetrahydrobenzoselenazole); naphthoselenazole (e.g. naphtho[1,2-d]selenazole or naphtho[2,1-d]selenazole); oxazole (e.g. oxazole, 4-methyloxazole, 4-phenyloxazole, 4,5-diphenyloxazole or 4,5-tetramethyleneoxazole); benzoxazole (e.g. benzoxazole, 5-chlorobenzoxazole, 6-chlorobenzoxazole, 5,6-dimethylbenzoxazole, 5-phenylbenzoxazole, 5-hydroxybenzoxazole, 5-methoxybenzoxazole, 5-ethoxybenzoxazole, 6-dialkylaminobenzoxazole, 5-carboxybenzoxazole, 5-sulphobenzoxazole, 5-sulphonamidobenzoxazole or 5-β-carboxyvinylbenzoxazole); naphthoxazole (e.g. naphtho[1,2-d]oxazole, naphtho[2,1-d]oxazole or naphtho[2,3-d]oxazole); imidazole (e.g. 1-methylimidazole, 1-ethyl-4-phenylimidazole or 1-butyl-4,5-dimethylimidazole); benzimidazole (e.g. 1-methylbenzimidazole, 1-butyl-4-methylbenzimidazole, 1-ethyl-5,6-dichlorobenzimidazole or 1-ethyl-5-trifluoromethylbenzimidazole); naphthimidazole (e.g. 1-methylnaphtho[1,2-d]imidazole or 1-ethylnaphtho[2,3-di]imidazole); 3,3-dialkylindolenine (e.g. 3,3-dimethylindolenine, 3,3,5-trimethylindolenine or 3,3-dimethyl-5-methoxyindolenine); 2-pyridine (e.g. pyridine, 3-methylpyridine, 4-methylpyridine, 5-methylpyridine, 6-methylpyridine, 3,4-dimethylpyridine, 3,5-dimethylpyridine, 3,6-dimethylpyridine, 4,5-dimethylpyridine, 4,6-dimethylpyridine, 4-chloropyridine, 5-chloropyridine, 6-chloropyridine, 3-hydroxypyridine, 4-hydroxypyridine, 5-hydroxypyridine, 6-hydroxypyridine, 3-phenylpyridine, 4-phenylpyridine or 6-phenylpyridine); 4-pyridine (e.g. 2-methylpyridine, 3-methylpyridine, 2,3-dimethylpyridine, 2,5-dimethylpyridine, 2,6-dimethylpyridine, 2-chloropyridine, 3-chloropyridine, 2-hydroxypyridine or 3-hydroxypyridine); 2-quinoline (e.g. quinoline, 3-methylquinoline, 5-methylquinoline, 7-methylquinoline, 8-methylquinoline, 6-chloroquinoline, 8-chloroquinoline, 6-methoxyquinoline, 6-ethoxyquinoline, 6-hydroxyquinoline, 8-hydroxyquinoline, or 5-oxo-5,6,7,8-tetrahydroquinoline); 4-quinoline, (e.g. quinoline, 6-methoxyquinoline, 7-methylquinoline or 8-methylquinoline) isoquinoline (e.g. isoquinoline or 3,4-dihydroisoquinoline); thiazoline (e.g. thiazoline or 4-methylthiazoline); further, those based on pyrroline, tetrahydropyridine, thiadiazole, oxadiazole, pyrimidine, triazine or benzothiazine. The heterocyclic rings and aryl groups may in addition carry any other substituents, e.g. other alkyl groups which preferably have up to 3 carbon atoms (such as methyl or ethyl); halogen (such as chlorine, bromine or iodine) or the trifluoromethyl group, hydroxyl, alkoxy which preferably contains up to 3 carbon atoms (such as methoxy or ethoxy), hydroxyalkyl, alkylthio, aryl (such as phenyl) or aralkyl (such as benzyl), amino or substituted amino;

$Z^3$ represents the ring members required for completing an isocyclic or heterocyclic ketomethylene ring which may be any of the usual ketomethylene rings of cyanine chemistry, for example those based on rhodanine (such as 3-ethylrhodanine, 3-allylrhodanine, 3-cyclohexylrhodanine); 2-thio-2,4-oxazolidine dione (such as 3-ethyl-2-thio-2,4-oxazolidine dione); thiohydantoin (such as 1,3-dimethyl-2-thiohydantoin, 1-methyl-3-phenyl-2-thiohydantoin); a barbituric acid or thiobarbituric acid (such as 1,3-diethyl-thiobarbituric acid, 1,3-diphenylthiobarbituric acid); isoxazolone, oxindole, 2-thio-2,5-thiazolidine dione or 2,4-imidazolidine dione or 1,3-indandione;

$Z^4$ stands for the members required for completing a 5- or 6-membered isocyclic ring such as cyclopentene or cyclohexene (e.g. 4,4-dimethylcyclohexene);

$Z^5$ represents S or $>N-R^9$;

Y represents a radical represented by one of the following general formulae:

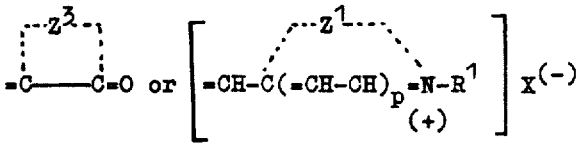

wherein $Z^1$, $Z^3$, p, $R^1$ and $X^{(-)}$ have the meanings indicated above.

Polymethine dye bases (so-called dequaternized polymethine dyes) of the following general formulae VII and VIII may also be used:

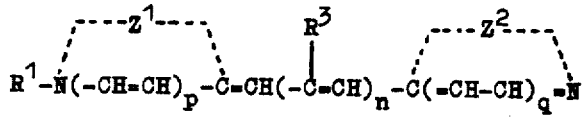
VII
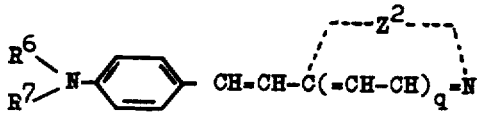
VIII
wherein $R^1$, $R^3$, $R^6$, $R^7$, $Z^1$, $Z^2$, $n$, $p$ and $q$ have the meanings indicated above.
Particular utility is exhibited by the polymethine dyes of the following formulae:
1 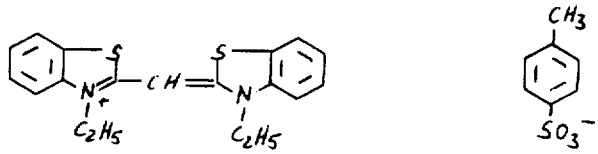
2 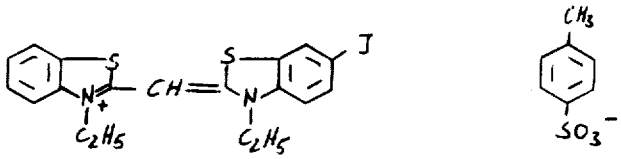
3 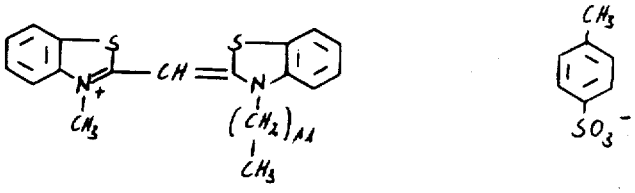
4 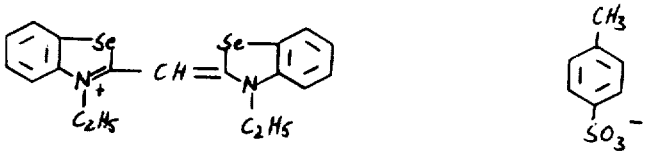
5 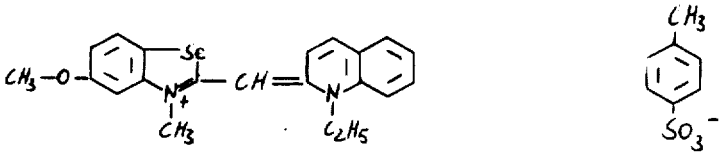
6 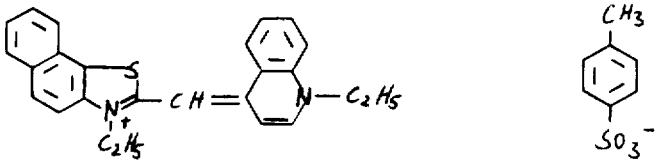
7 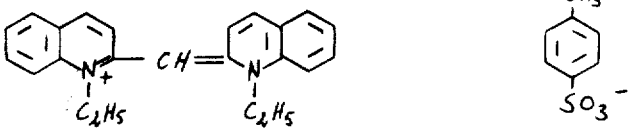

8 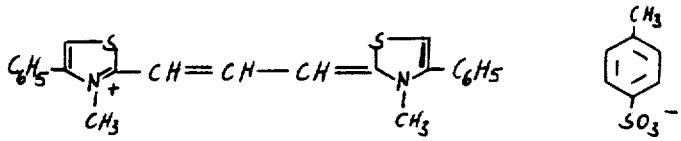
9 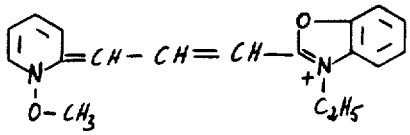
10 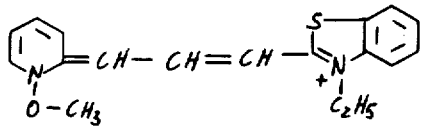
11 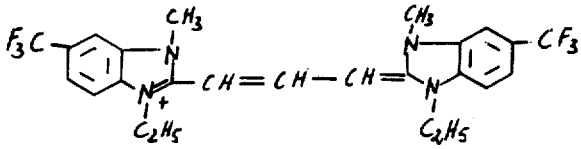
12 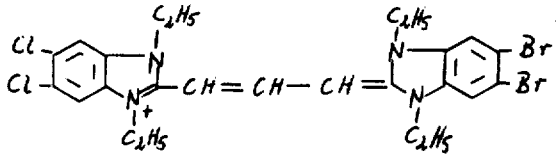
13 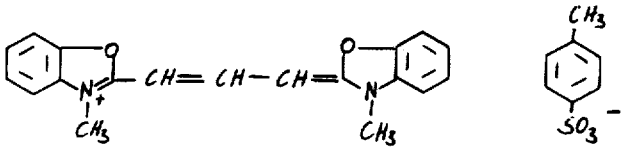
14 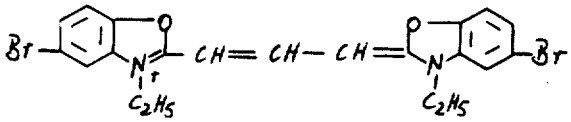
15 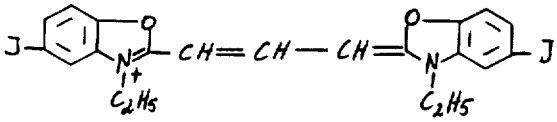
16 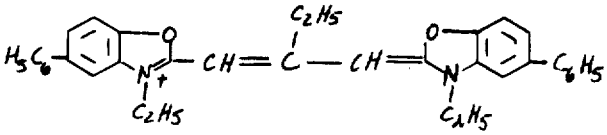
17 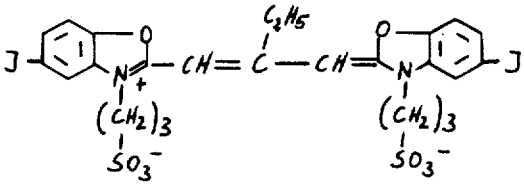

18 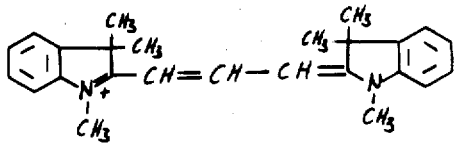
$ClO_4^-$
19 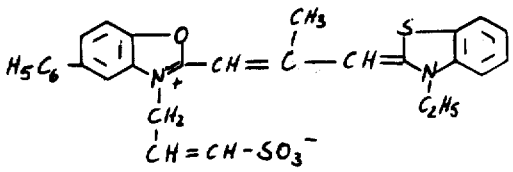
20 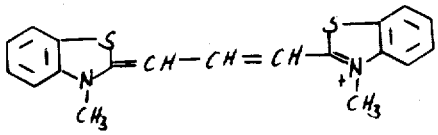
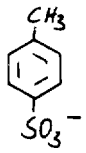
21 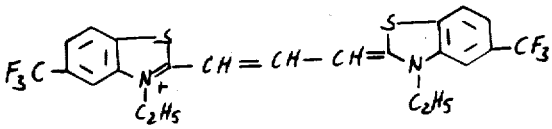
$C_2H_5SO_4^-$
22 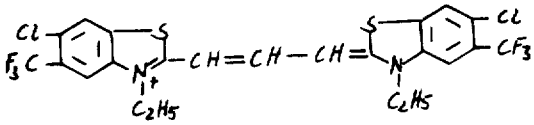
$C_2H_5SO_4^-$
23 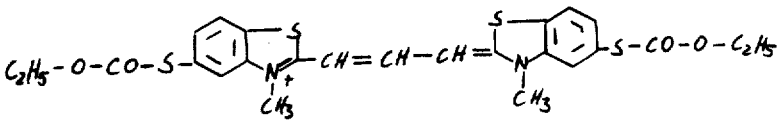
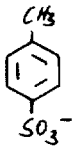
24 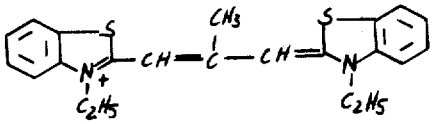
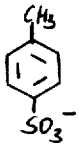
25 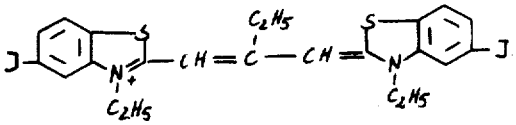
$C_2H_5SO_4^-$
26 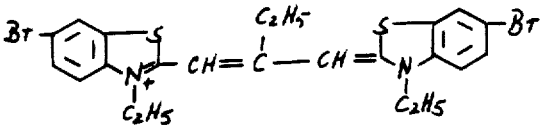
$ClO_4^-$
27 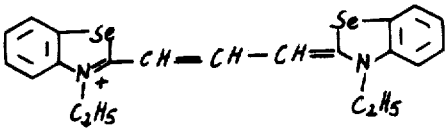
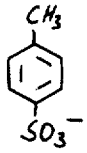
28 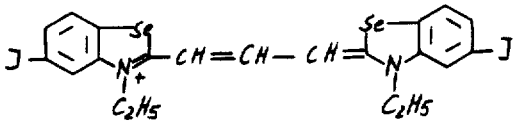
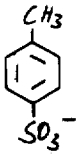

29 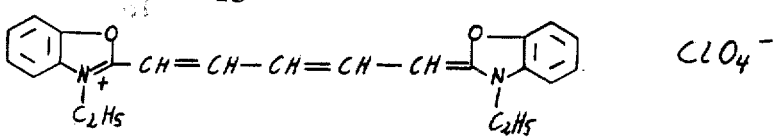
30 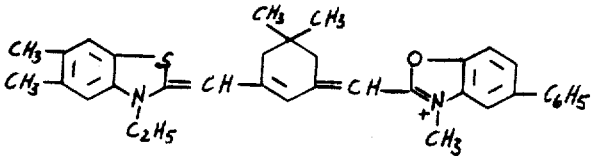
31 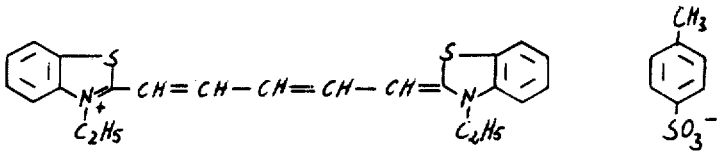
32 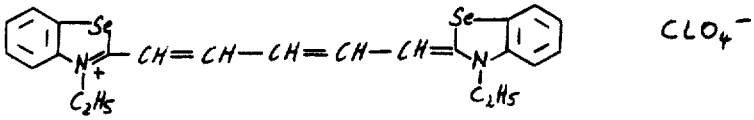
33 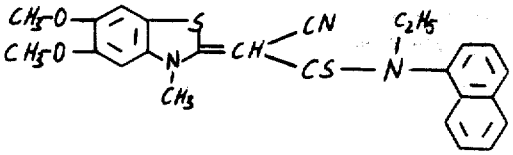
34 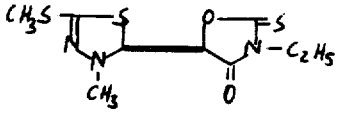
35 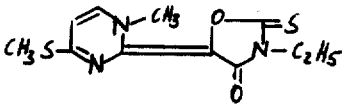
36 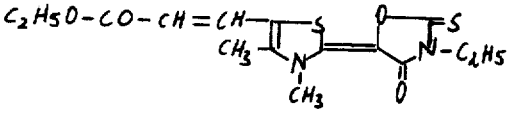
37 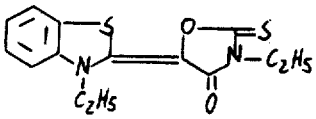
38 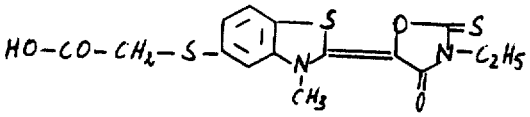
39 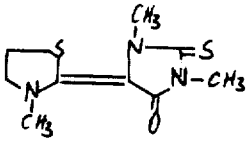

40 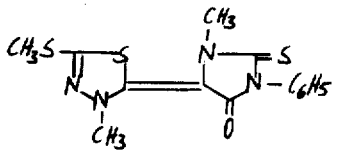
41 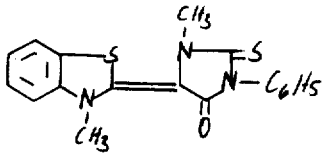
42 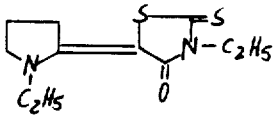
43 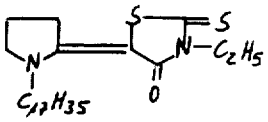
44 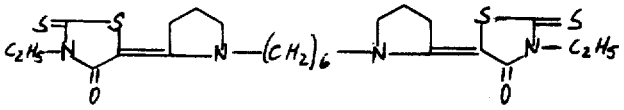
45 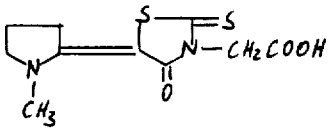
46 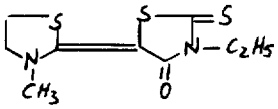
47 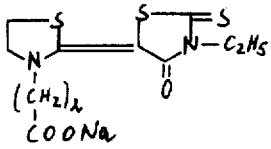
48 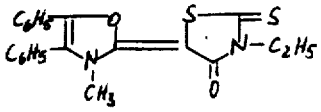
49 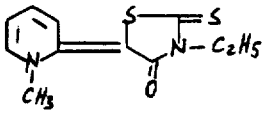
50 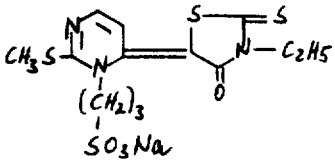

51 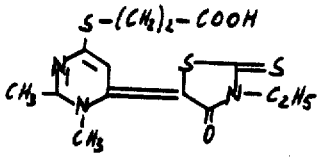
52 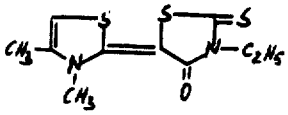
53 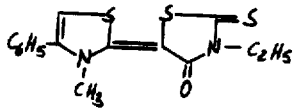
54 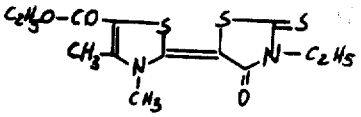
55 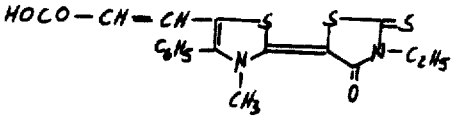
56 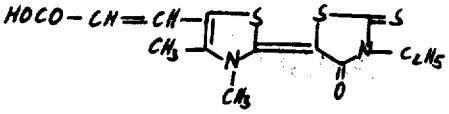
57 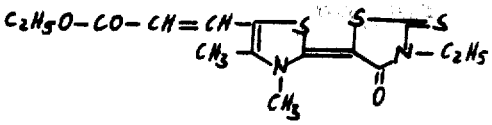
58 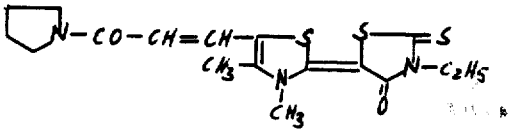
59 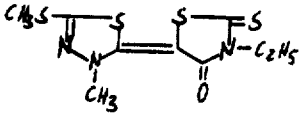
60 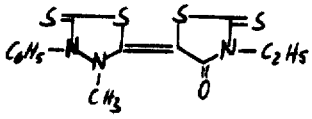
61 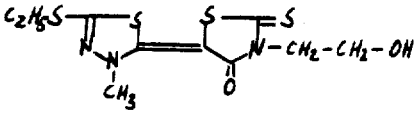

62 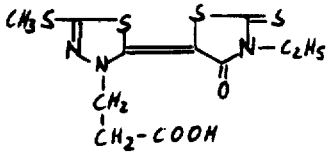
63 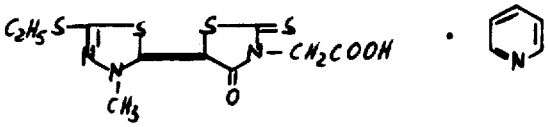
64 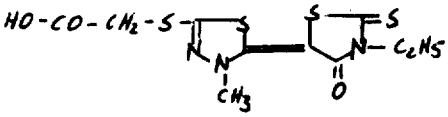
65 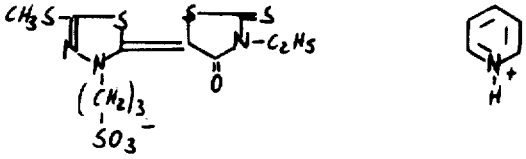
66 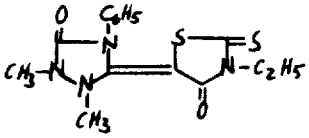
67 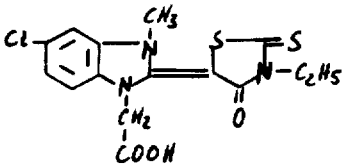
68 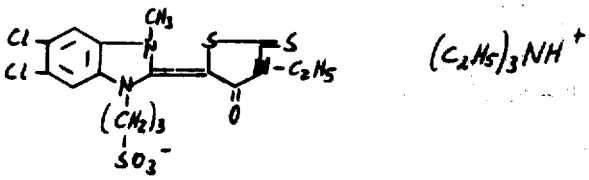
69 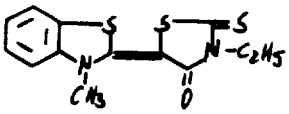
70 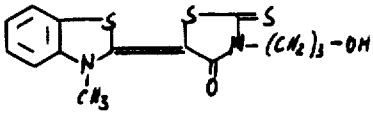
71 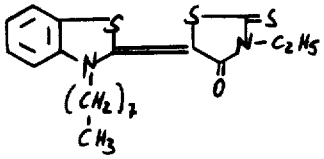
72 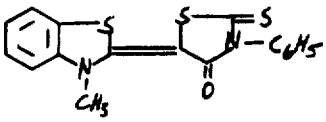

73 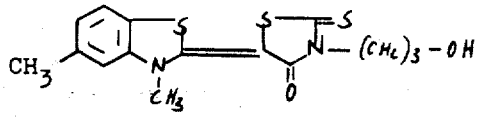
74 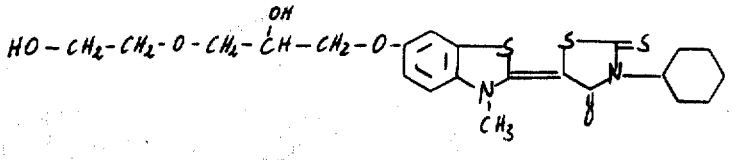
75 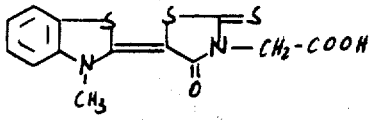
76 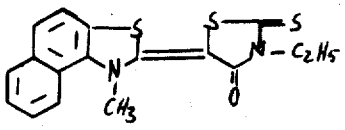
77 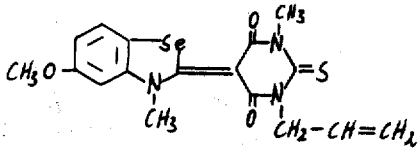
78 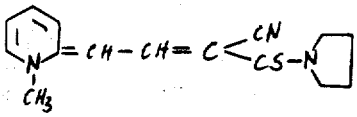
79 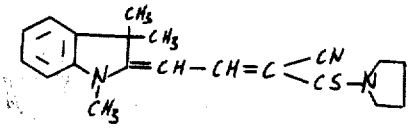
80 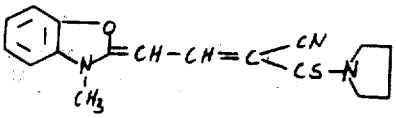
81 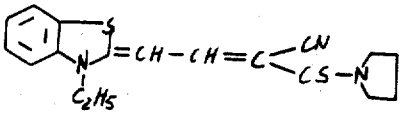
82 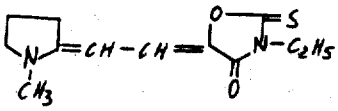
83 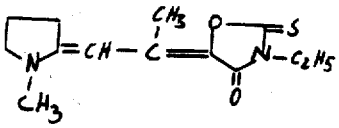

84 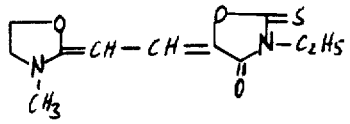
85 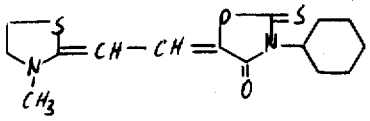
86 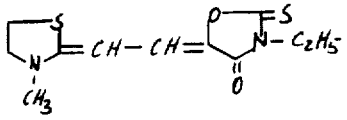
87 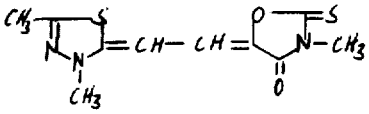
88 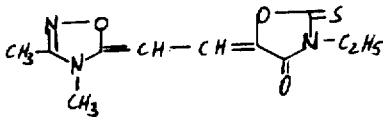
89 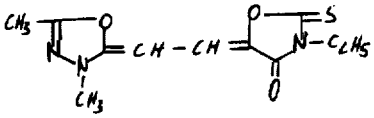
90 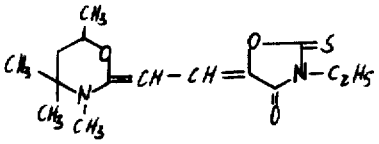
91 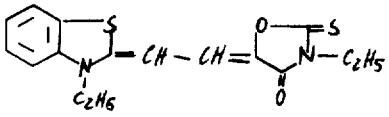
92 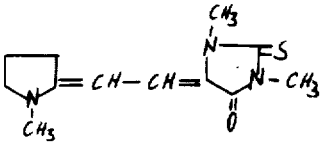
93 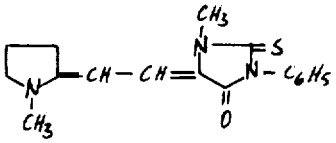
94 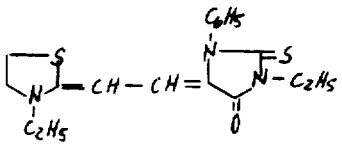
95 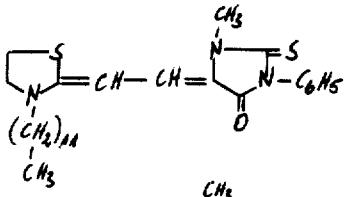
96 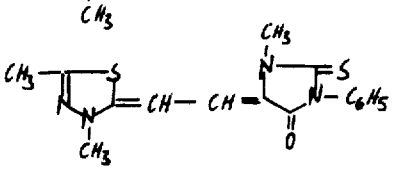
97 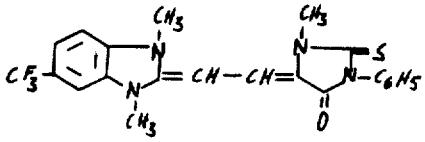
98 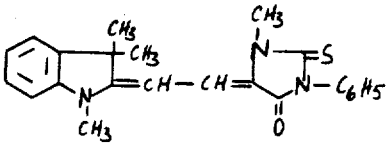
99 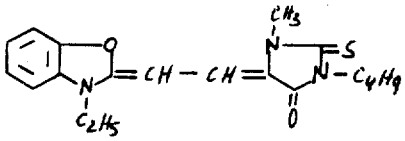
100 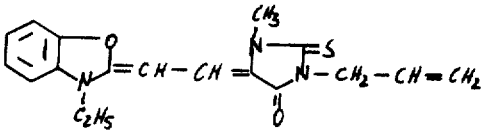
101 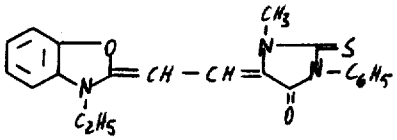
102 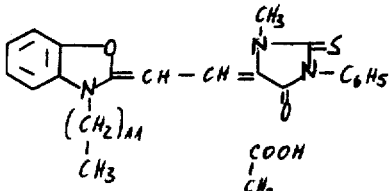
103 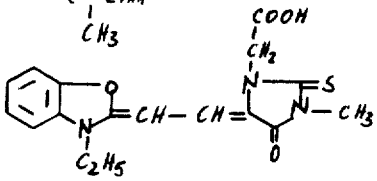
104 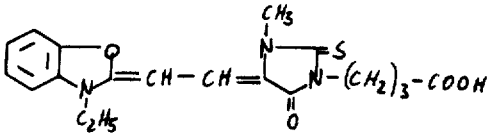
105 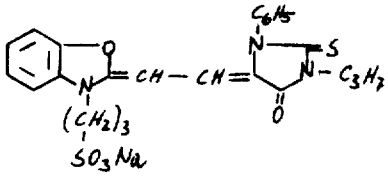

106 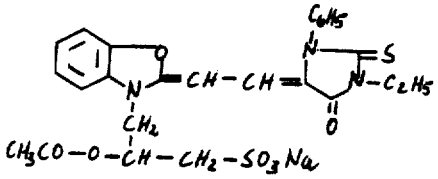
107 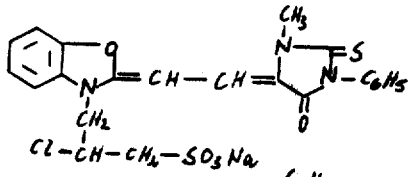
108 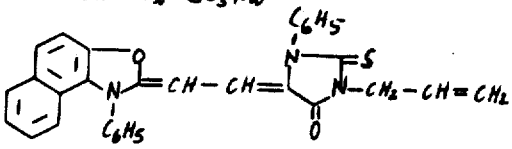
109 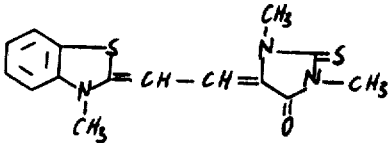
110 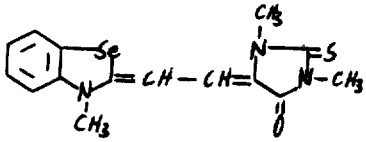
111 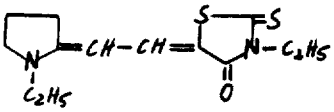
112 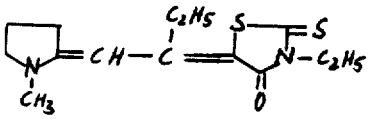
113 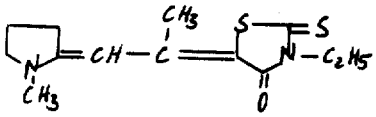
114 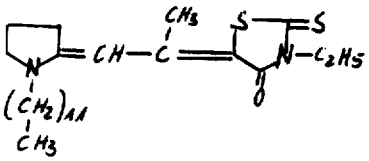
115 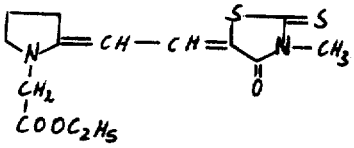
116 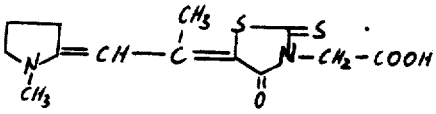

117 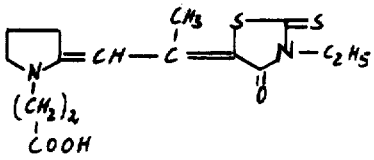
118 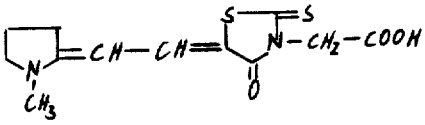
119 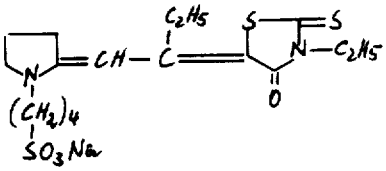
120 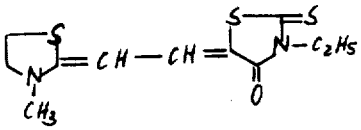
121 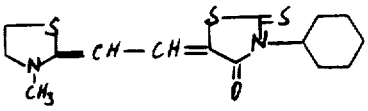
122 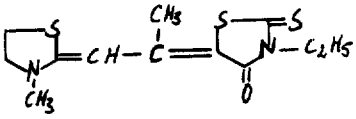
123 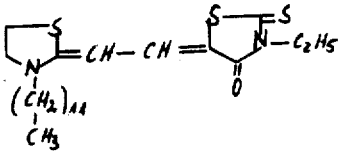
124 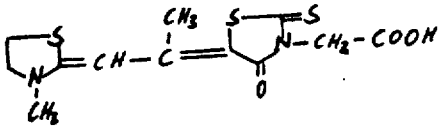
125 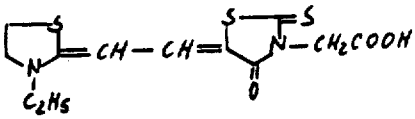
126 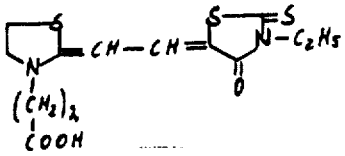
127 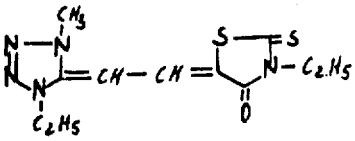
128 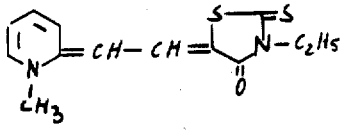
129 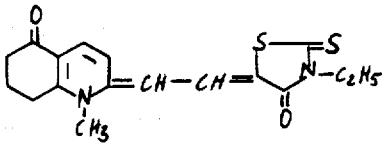
130 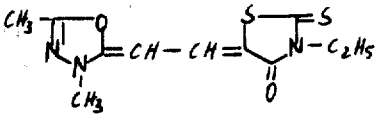
131 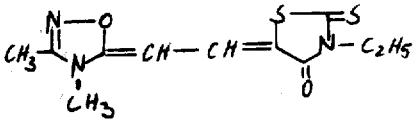
132 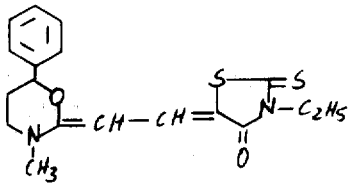
133 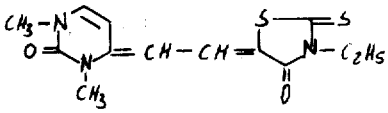
134 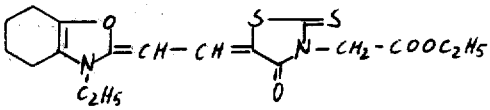
135 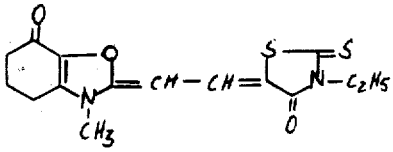
136 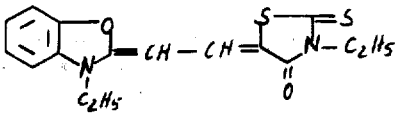
137 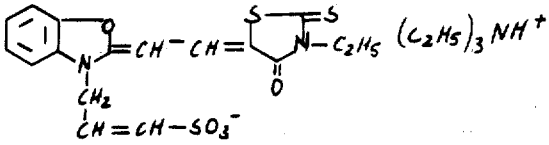
138 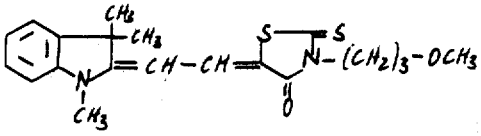

139 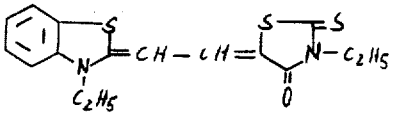
140 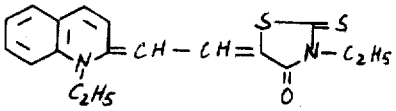
141 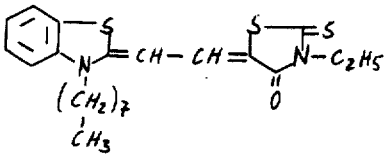
142 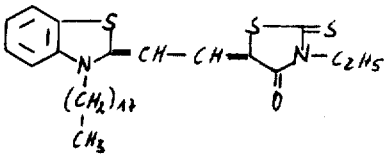
143 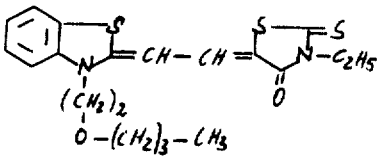
144 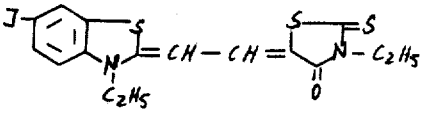
145 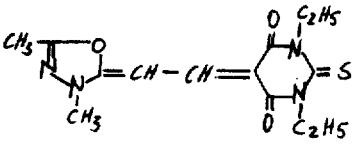
146 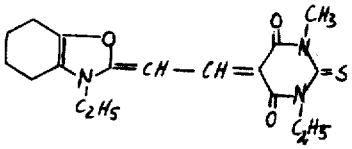
147 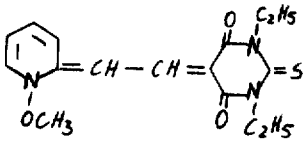
148 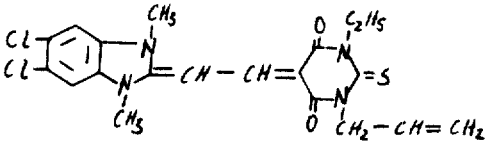
149 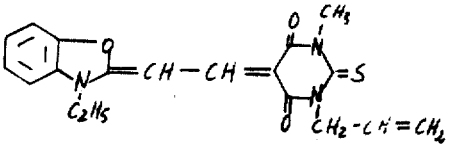
150 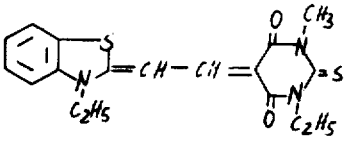
151 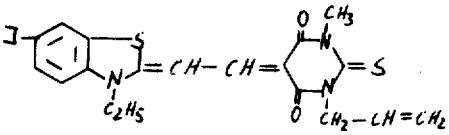
152 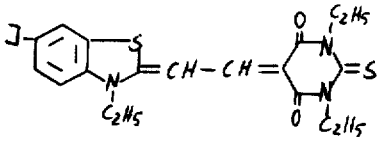
153 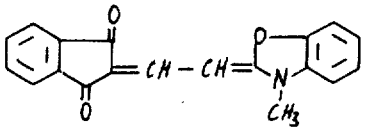
154 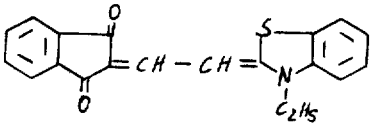
155 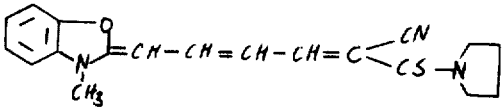
156 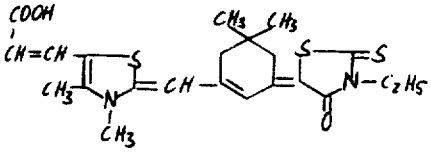
157 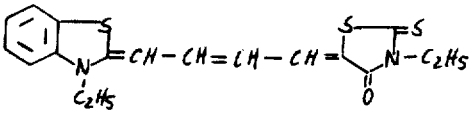
158 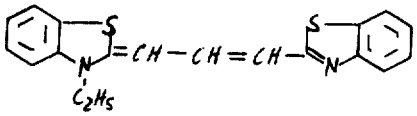
159 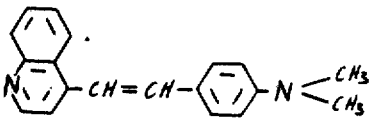
160 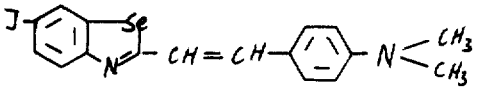

161 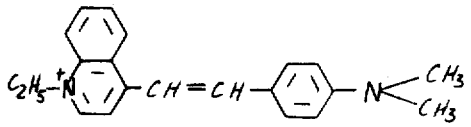
162 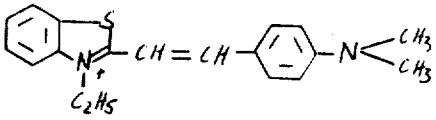
163 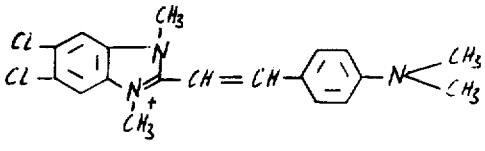
164 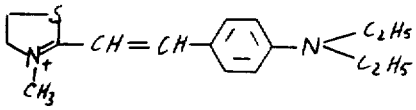
165 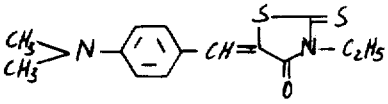
166 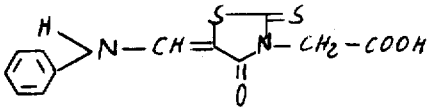
167 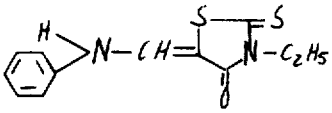
168 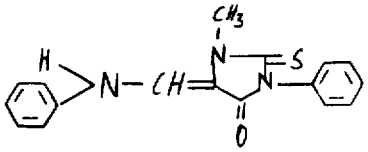
169 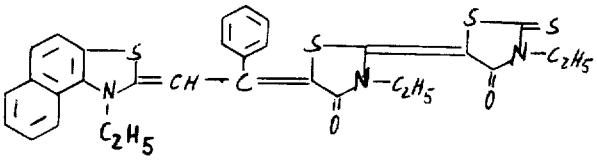
170 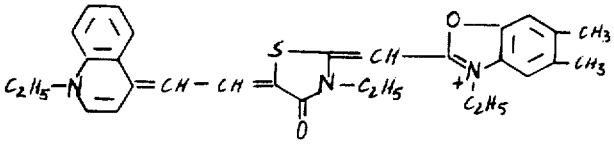
171 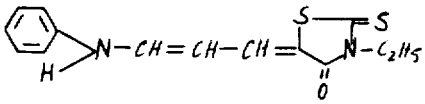

172 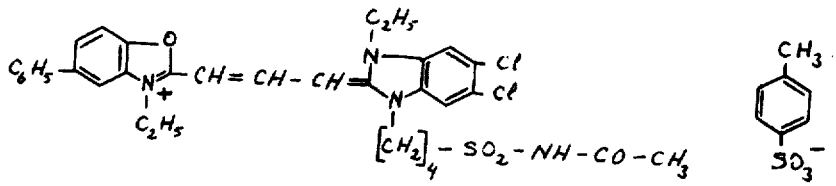

173 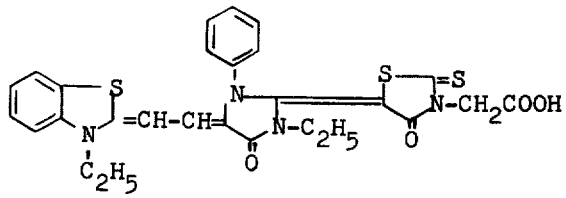

174 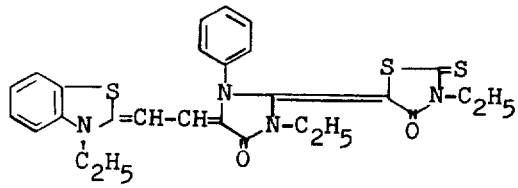

175 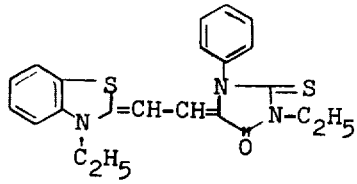

176 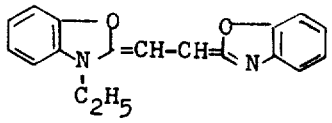

177 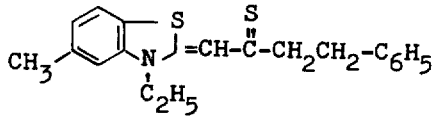

178 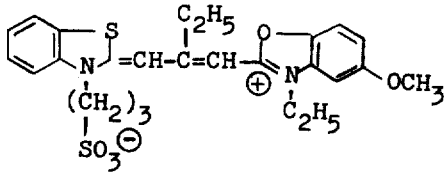

The sensitizers according to the invention may be prepared by methods known in the literature. Numerous such methods have been described in the monograph by F. M. HAMER "The Cyanine Dyes and Related Compounds" (1964) Interscience Publishers John Wiley and Sons.

The sensitizers are generally added to the casting solutions described below in the form of solutions in organic solvents but they may also be added in solid form either to the silver salt before it is ground or to the casting solution shortly before it is applied to a support. The concentration of sensitizer in the layer may vary within wide limits and depends on the effect required and the nature of the sensitizer in combination with the silver salt. Concentration of 0.1 to 2 g of sensitizing dye per mol of silver salt and particularly 0.2 to 0.6 g have generally been found to be sufficient. If desired, the sensitizers may also be added in quantites outside this range.

The process of the invention is preferably carried out so that after processing the sensitizing dye causes no residual coloring of the layers which contain the image. In the case of highly active sensitizers, this can be achieved by keeping their concentration as low as possible. It can also be achieved by using sensitizers which are decolorized by the heat used for development in the process of the present invention or by a brief after exposure of the final processed copies. Sensitizers of this kind have been described e.g. in German Pat. Specification No. 1,950,735.

The photographic copies then obtained have no sensitivity to light because the layers of the invention contain only silver compounds which have no natural spectral sensitivity.

Silver salts suitable for the photographic material of the invention are silver salts of organic acids or of NH-acidic compounds which under the conditions of the process are insensitive or only negligibly sensitive to light in the absence of a sensitizing dye. Such silver salts include, for example, the known silver salts of benzotriazole or saccharin or, particularly, the silver salts of long chain fatty acids which contain up to 30 carbon atoms, e.g. silver stearate, silver palmitate or silver behenate or the silver salts of aliphatic carboxylic acids containing a thioether group as described in U.S. Pat. Specification No. 3,330,663.

Suitable combinations of silver salts, reducing agents and developer substances for the photographic material of the present invention can be determined by simple tests. For example, the silver salt may be dispersed in a solvent or solution of binder and one of the reducing described hereinafter may be dissolved or dispersed therein. The mixture must not undergo discoloration in the dark at room temperature and it should turn greyish black relatively rapidly when heated to temperatures of 60° to 90°C.

The silver salts may be prepared by precipitating methods known e.g. by mixing solutions of silver nitrate or ammoniacal silver nitrate, with the alkali metal or ammonium salts of the organic acids or NH-acidic compounds. Precipitation may also be performed with the free acids alone or with their mixtures of alkali metal salts. Precipitation may be carried out in aqueous or aqueous/alcoholic solution or in the presence of some other solvent such as acetone. If the reaction is carried out in the presence of ammonia, the silver salt may be precipitated by acidification, e.g. with nitric acid. The organic acid and silver salt may be used in stoichiometric proportions or an equimolar excess of the organic acid may be applied.

After drying, the silver salts are added to the solutions or dispersions of the desired binding agent for the layer. The concentration of silver salt in the dispersion of the binding agent may vary within wide limits, depending on the amount of silver desired in the photographic layers. Quantities of 0.1 to 0.01 mol of silver salt per kilogram of casting solution are generally sufficient. The amount of silver salt preferably used is 0.02 to 0.04 mol per kilogram of solution or dispersion. The same applies to the amount of silver used in the finished photographic layer, where again the concentration may be varied within wide limits according to the desired effect and the purpose for which the material is to be used. The amount of silver applied would generally be 0.1 to 3 g of silver in the form of silver salt per square meter, perferably 0.3 to 1 g/m². Mixtures of various silver compounds which are insensitive to light may, of course, also be used in the material according to the invention.

The following are examples of suitable silver salts:

silver stearate,
silver behenate,
silver stearate and stearic acid (molar ratio 1:1),
silver behenate and behenic acid (molar ratio 1:1),
1-benzotriazolyl silver,
N-(benzoic acid-sulfonic acid-(2)-imide) silver,
N-(4-nitrobenzoic acid-sulfonic acid-(2)-imide) silver,
N-(5-nitrobenzoic acid-sulfonic acid-(2)-imide) silver,
N-(2H-1-oxo-phthalazinyl) silver,
N-phthalimide silver,
1-benzimidazolyl silver,
S-alkyl-thioglycolic acid silver in which the alkyl group contains 12 to 22 carbon atoms,
silver 2-alkylthio-5-(carboxylatomethylthio)-1,3,4-thiodiazole (alkyl containing 1 to 22 carbon atoms),
silver 3-(carboxylatomethylthio)-1,2,4-triazole.

Some of the silver salts which can be used for the present invention and which are basically insensitive to light show a certain, even if slight, inherent sensitivity if they are precipitated in the presence of a protective colloid such as a protein, particularly gelatin. Precipitation of the silver salts for preparing the material according to the invention must therefore be carried out in such a manner that the resulting silver salts are insensitive to light. This can generally be achieved by precipitating in the absence of a sensitizing protective colloid.

To improve the photographic properties of the material of the invention, other heavy metal compounds which are insensitive to light may be added to the material, preferably to the layer which contains the silver salt. The improvements which may thereby be achieved are e.g. reduction in the fog, increase in the density and shift of the image tone to desired color tones, e.g. towards neutral black.

Suitable heavy metal compounds for this purpose are e.g. salts or other compounds of mercury, cadmium, lead, uranium, gold, platinum, palladium or rhodium. The heavy metal compounds may be added at the stage of precipitation of the silver salt, in which case solutions of the heavy metal salts and of the silver salts are preferably added simultaneously to the precipitation component and precipitated at the same time. Although simultaneous precipitation of silver salt and heavy metal salts is particularly advantageous and results in particularly advantageous effects varying according to the nature of the heavy metal salt, the heavy metal salts may also be added in solid or dissolved form to the casting solutions for the photographic layer which already contain the silver salt. The heavy metal salts may also be mixed with the dried silver salts by grinding or added shortly before the casting solution for the photographic layer is applied on to the support. Combinations of various heavy metal salts can also be used.

The quantity of heavy metal salts or heavy metal compounds added may vary within wide limits and again depends on the nature of the heavy metal salts and of the silver salt and on the effect desired. The optimum quantity can easily be determined by a few simple laboratory tests which can be performed by any skilled person. The heavy metal salts often produce a more pronounced effect when the method of simultaneous precipitation is employed. Concentrations of 0.001 to 10 mols percent, particularly 0.01 to 5 moles percent, are usually sufficient to obtain the desired effect. If the heavy metal salts are added at a later stage of the preparation of the photographic material, before the material is cast, concentrations of 0.001 to 0.2, particularly 0.005 to 0.07 mol of heavy metal salt per mol of silver salt are sufficient.

The following are examples of suitable heavy metal salts of organic acids, NH-acidic compounds and organic mercury compounds:

mercury(II) acetate
mercury(II) propionate
mercury(II) hexanoate
mercury(II) laurate
mercury(II) palmitate
mercury(II) behenate
mercury(II) succinate
mercury(II) malate mercury(II) adipate
mercury(II) suberate
mercury(II) azelate
mercury(II) sebacate
cadmium(II) stearate
cadmium(II) acetate
cadmium(II) behenate
lead(II) acetate
lead(II) stearate
N,N'-bis-(phthalimide) mercury(II)
N,N'-bis-(succinimide) mercury(II)
1,1'-bis-(benzotriazolyl) mercury(II)
N,N'-bis-(phthalimide) lead(II)
gold resinate (24 % Au)
uranyl acetate
Bis-(2H-1-oxo-phthalazinyl-(2))-nickel(II)
Phenyl-mercury(II) acetate
3-(phenylmercury(II))-8-hydroxyquinoline
1-benzotriazolyl-mercury(II) acetate
1-benzimidazolyl-mercury(II) acetate
N-phthalimide-mercury(II) acetate
Bis-(2H-1-oxo-phthalazinyl-(2))-mercury(II)
Bis-(3-methoxypropyl-mercury(II)) oxalate
Bis-(2-ethoxyethyl-mercury(II)) tartrate
(9-methoxy-1-carboxy-heptadecyl-8)-mercury(II)-acetate
mercury(II)-di-(5-sulfido-1-phenyl-tetrazol)
mercury(II)-di-hexadecylsulfide
2,2'-bis-thienyl-mercury(II)

and the mercury compounds represented in Table 3 below:

1.

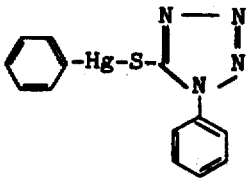

2.

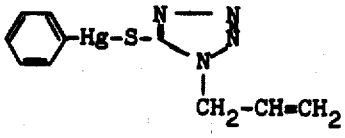

3.

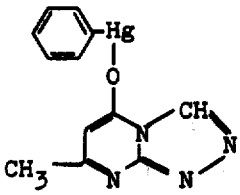

4.

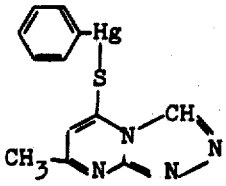

5.

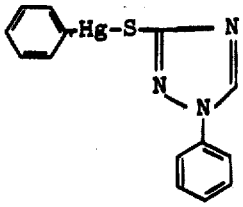

6.

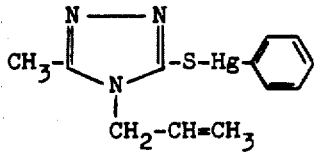

7.

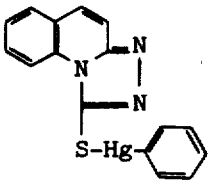

8.

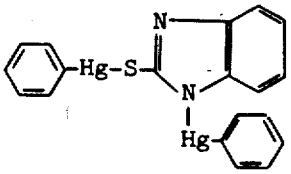

9.

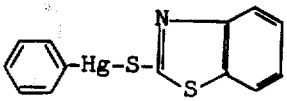

10.

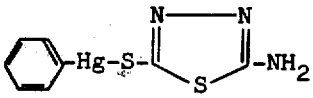

11.

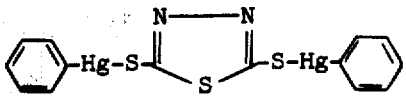

12.

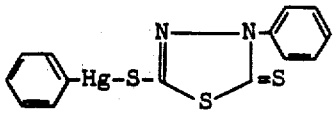

13.

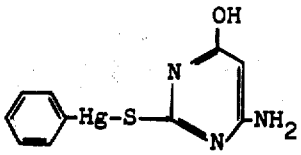

14.

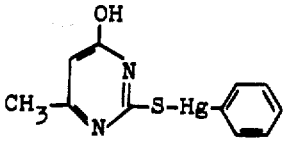

15.

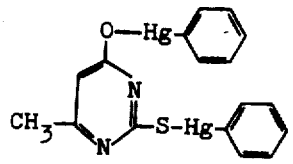

16.

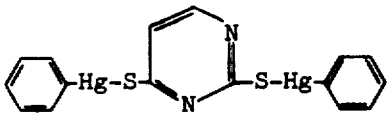

17.

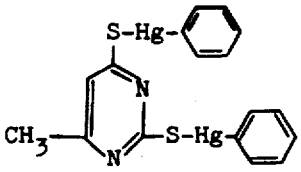

18.

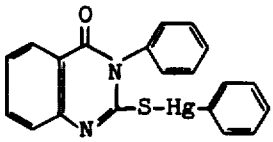

19.

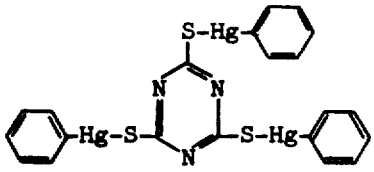

20.

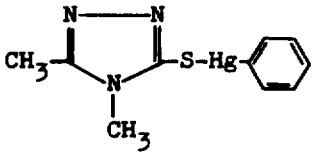

21.

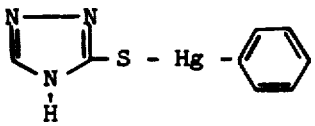

22.

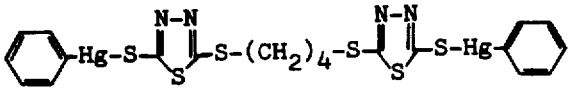

23.

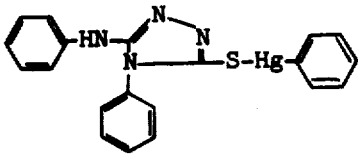

24.

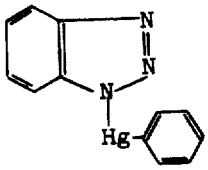

In the above compounds the mercury may be attached to the ring nitrogen atoms instead of to sulfur, owing to the tautomeric equilibris.

The preparation of the above mentioned compounds is known per se and is carried out by reacting phenylmercury acetate, mercury(II) oxide, mercury(II)-nitrate, mercury(II) acetate with the corresponding heterocyclic mercapto- NH-acidic- or hydroxyl compound or carboxylic acids. For methods of preparation, reference may be made in U.S. Pat. No. 3,356,503 or to Ann. Vo. 15, page 189.

The reducing agents used for the photographic material according to the invention may be organic compounds known per se for this purpose, which contain at least one active hydrogen atom attached to O, N or C. The known photographic developers, for example, are compounds of this type. The suitability of an organic reducing agent for the present invention can easily be determined by the test described above. It is preferred to use reducing agents which have little or no color of their own so that they do not discolor the photographic layer.

The concentration of reducing agent in the photographic layer may also vary within wide limits and the quantity added depends on the activity of the reducing agent and the desired effect. The optimum quantity can easily be determined by a few simple tests. Quantities of 0.25 to 2, preferably 0.5 to 2 mols of reducing agent per mol of silver salt are generally sufficient, and the amount used is preferably about 1 mol. Combinations of several reducing agents may, of course, be used.

The reducing agents may be added to the casting solutions for the photographic layer in the form of their solutions in suitable, generally organic, solvents but they may also be mixed with the silver salt in the solid form by grinding. The reducing agent may be added to the photographic layer which contains the silver salt or, preferably, to a layer adjacent to the silver salt layer.

The following are examples of suitable reducing agents:

1. Phenols and naphthols which contain at least one hydroxyl group and which may be substituted with alkyl groups which contain up to 18 carbon atoms, aralkyl, substituted aralkyl, cycloalkyl, aryl, substituted aryl, halogen (e.g. chlorine), alkoxy groups containing up to 18 carbon atoms, carboxyalkyl, alkoxycarbonyl, carboxyl, acyl, acylamido, alkylthio, 5-tetraazolylthio, 2-benzothiazolylthio or morpholinoalkyl groups.

The following are examples of particularly suitable compounds:

Pyrocatechol,
3-cyclohexylpyrocatechol,
4-cyclohexylpyrocatechol,
4-(α-methylbenzyl)pyrocatechol,
dicyclohexylpyrocatechol,
4-phenylpyrocatechol,
hydroquinone,
2-alkyl-hydroquinone in which the alkyl group contains 1-18 carbon atoms, 2,5-dihydroxyalkyl-hydroquinone, in which the alkyl group contains 1–18 carbon atoms,
2,5-di-tert.-butyl-hydroquinone,
2-ethoxycarbonyl hydroquinone, 2,5-dichlorohyroquinone,
(2,5-dihydroxyphenyl)-5-(1-phenyltetrazolyl) sulfide, (6-methyl-2,5-dihydroxyphenyl)-5-(phenyltetrazolyl) sulfide,
(2,5-dihydroxyphenyl)-2-(benzothiazolyl) sulfide,
2-dodecyl-5-(5-carboxypentyl)-hydroquinone,
2-dodecyl-5-(9-carboxynonyl)-hydroquinone,
2-tetradecyl-5-(5-carboxypentyl)-hydroquinone,
2-tetradecyl-5-(9-carboxynonyl)-hydroquinone,
2-cyclohexylhydroquinone,
homogentisic acid,
homogentisic acid amide,
N,N-dimethyl-homogentisic acid amide,
N,N-diethyl-homogentisic acid amide,
homogentisic acid-N-allylamide,
S-(2,5-dihydroxyphenyl)-thioglycolic acid ethyl ester,
resorcinol,
4-alkyl-resorcinol in which the alkyl group contains 1-18 carbon atoms,
4,6-di-tert.-butylresorcinol,
pyrogallol,
gallic acid,
gallic acid alkyl ester in which the alkyl group contains 1-16 carbon atoms,
3,4,5-trihydroxyacetophenone,
1,4-dihydroxynaphthalene,
2,3-dihydroxynaphthalene,
1-hydroxy-4-methoxynaphthalene,
2,2'-dihydroxy-1,1'-binaphthyl,
1-hydroxy-4-ethoxynaphthalene,
1-hydroxy-4-propoxynaphthalene,
1-hydroxy-4-isopropoxnaphthalene,
1,hydroxy-2-methyl-4-methoxynaphthalene,
4,4'-dimethoxy-1,1'-dihydroxy-2,2'-binaphthyl,
1-hydroxy-5-methoxynaphthalene,
morpholino-(1-hydroxy-4-methoxy-naphthyl-(2))-methane,
bis-(2-hydroxynaphthyl-(1))-methane,
4,4'-dihydroxydiphenyl,
4-methoxyphenol,
2-methyl-4-methylmercapto-phenol,
2,6-di-tert.-butyl-p-cresol,
2,6-dicyclohexyl-p-cresol,
2,6-dicyclopentyl-p-cresol,
2-tert.-butyl-6-cyclopentyl-p-cresol,
2-tert.-butyl-6-cyclohexyl-p-cresol,
2,5-dicyclopentyl-p-cresol,
2,5-dicyclohexyl-p-cresol,
2,6-di-tert.-butyl-phenol,
2-isopropyl-p-cresol,
2-cyclopentyl-4-tert.-butyl-phenol,
3-methyl-3-(3-methyl-4-hydroxyphenyl)-pentane,
3,5-di-tert.-butyl-4-hydroxybenzophenone,
3,5-di-tert.-butyl-4-hydroxycinnamic acid,
3,5-di-tert.-butyl-4-hydroxy-benzaldehyde,
3,5-di-tert.-butyl-4-hydroxycinnamic acid ethyl ester,
2,6-di-tert.-butyl-4-nonyl-phenol,
2,4-di-tert.-butyl-6-nonyl-phenol,
bis-(2-hydroxy-3-tert.-butyl-5-methylphenyl)-methane,
bis-(2-hydroxy-3-cyclohexyl-5-methylphenyl)-methane,
1,1-bis-(2-hydroxy-3,5-dimethylphenyl)-2-methylpropane,
1,1,5,5-tetrabis-(2-hydroxy-3,5-dimethylphenyl)-2,4-ethylpentane,
bis-(2-hydroxy-3,5-dimethylphenyl)-methane,
1,1-bis-(2-hydroxy-3,5-di-tert.-butyl-phenyl)-2-methylpropane,
2,2-bis-(4-hydroxy-3,5-di-tert.-butyl-phenylthio)-propane,
2,2-bis-(3,5-dichloro-4-hydroxyphenyl)-propane,
3,3',5,5'-tetramethyl-6,6'-dihydroxy-triphenylmethane,
2,2-bis-(4-hydroxyphenyl)-propane and
1,2-bis-(2-hydroxy-3-tert.-butyl-dibenzofuryl)-ethane.

The above mentioned di-alkoxy-hydroquinones with longer alkyl radicals are prepared by reducing the corresponding bis-alkoxy-quinones which in turn are obtained from alkoxy-quinones which are substituted with lower alkyl groups by esterification of these compounds with higher alcohols.

2. o- and p-Aminophenol derivatives and 1,4-, 1,5-, 2,3-and 2,6-aminonapththol derivatives of the following general formulae:

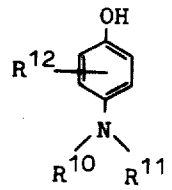

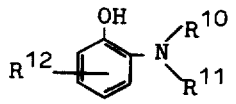

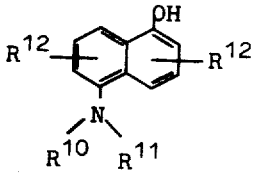

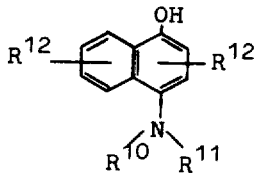

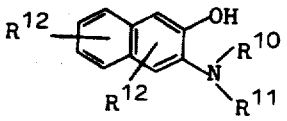

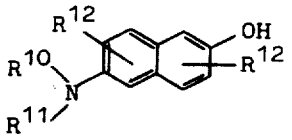

wherein $R^{10}$ and $R^{11}$ stand for hydrogen, alkyl containing 1 - 18 carbon atoms, acyl containing 1 - 18 carbon atoms or an alkoxycarbonyl, carboxymethyl or carbamoyl group substituted with alkyl containing 1 - 18 carbon atoms;

$R^{10}$ and $R^{11}$ together may represent an alkylidene or aralkylidene group;

$R^{12}$ represents alkyl containing 1 - 6 carbon atoms, aryl in particular phenyl, halogen (e.g. fluorine or chlorine), alkoxy, aroxy such as phenoxy, or alkoxycarbonyl.

The following are examples of suitable compounds:

4-amino-phenol,
4-benzylideneamino-phenol,
4-isopropylideneamino-phenol,
4-acylamino-phenol, in which the acyl group contains 2-18 carbon atoms,
N-(4-hydroxy-phenyl)-aminoacetic acid,
4-hydroxyphenyl-carbamic acid ethyl ester,
6-dimethylamino-3-hydroxy-toluene,
N-(4-hydroxyphenyl)-N'-alkyl-urea in which the alkyl group contains 1 to 18 carbon atoms,
N-(4-hydroxy-3,5-di-tert.-butyl-phenyl)-N'-octadecyl-urea,
N-(4-hydroxy-3,5-dichloro-phenyl)-N'-octadecyl-urea,
3-chloro-4-hydroxy-diphenylamine,
4-(4-hydroxybenzylidene-amino)-2-methyl-phenol,
4-(4-hydroxybenzylidene-amino)-3-methyl-phenol,
4-(3-hydroxybenzylidene-amino)-phenol,
αα'-bis-(4-hydroxyphenylimino)-p-xylene,
4-benzylidene-amino-2-methyl-phenol,
4-(2-hydroxybenzylidene-amino)-phenol,
αα'-bis-(4-hydroxy-3-methyl-phenylimino)-p-xylene,
2-acylamino-phenol in which the acyl group contains 1-18 carbon atoms,
N-(2-hydroxyphenyl)-N'-alkyl-urea in which the alkyl group contains 1-18 carbon atoms,
6-amino-phenol-sulfonic acid-(3) amide,
6-amino-phenol-sulfonic acid-(3) dimethylamide,
2-amino-phenol-sulfonic acid-(4) amide,
2-benzylideneamino-phenol,
4-(4-hydroxybenzylidene-amino)-phenol,
αα'-bis-(2-hydroxyphenylimino)-p-xylene,
3-(2-hydroxyphenyl)hydrazono)-2-oxo-oxolane,
3-(4-hydroxyphenyl-hydrazono)-2-oxo-oxolane,
2-hydroxy-3-amino-naphthalene,
1-hydroxy-5-acylamino-naphthalene in which the acyl group contains 1-18 carbon atoms,
4-hydroxyanilino-methane-sulfonic acid,
4-hydroxy-3-methylanilino-methanephosphonic acid.

3. N,N-Dialkyl-p-phenylenediamine derivatives, particularly those in which the alkyl groups contain up to 3 carbon atoms and in which the phenylene nucleus may be substituted with alkyl or alkoxy groups.

The free primary amino group may be blocked, for example in the form of a Schiff's base by reaction with aldehydes, particularly benzaldehyde, or by a sulfomethyl group which may be introduced by a Mannich reaction. The phenylene-diamine derivatives which contain a blocked primary amino group are particularly suitable because the storage stabilizing of the photographic layers is improved.

The following compounds have been found to be suitable:

N,N-diethyl-p-phenylene-diaminesulfate,
N,N-dibenzylidene-p-phenylenediamine,
N,N-diethyl-N'-sulfomethyl-p-phenylenediamine,
N-benzylidene-N',N'-diethyl-p-phenylenediamine,
N,N-dimethyl-N'-sulfomethyl-p-phenylenediamaine,
3-methoxy-4-sulfomethylamino-N,N-diethylaniline,
N,N'-di-sulfomethyl-p-phenylenediamine,
N-(2-hydroxybenzylidene)-N',N'-diethyl-p-phenylenediamine,
N-(3-hydroxybenzylidene)-N',N'-diethyl-p-phenylenediamine and
N-(4-hydroxybenzylidene)-N',N'-diethyl-p-phenylenediamine.

The above mentioned substances are known per se. Methods of preparation of these substances have been published, e.g. in German Patent Specifications No. 1,159,758 and 1,203,129 or in the literature.

4. 6-Hydroxychroman derivatives and 5-hydroxycoumaran derivatives represented by the following general formula:

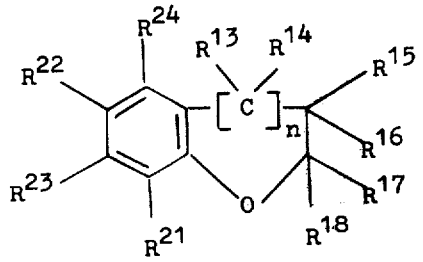

in which $n$ is 0 or 1;

$R^{13}$, $R^{14}$, $R^{15}$, $R^{16}$, $R^{17}$ and $R^{18}$ stand for hydrogen or alkyl groups containing up to 9 carbon atoms, preferably methyl groups;

$R^{15}$ and $R^{16}$ or $R^{16}$ and $R^{17}$ represent together a carbocyclic ring which contains 5 or 6 carbon atoms and which may contain a double bond and/or be substituted with alkyl groups containing up to 4 carbon atoms;

$R^{18}$ stands for an alkoxy group containing up to 6 carbon atoms or a tertiary amino group of the formula

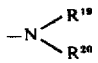

wherein $R^{19}$ and $R^{20}$ represent alkyl groups which contain up to 6 carbon atoms or the ring members required for completing a 5-, 6-or 7-membered ring, which ring may contain an oxygen atom or additional nitrogen atoms as ring member in addition to the nitrogen atom in the formula;

$R^{21}$, $R^{22}$ stand for hydrogen, alkyl or alkoxy with up to 6 carbon atoms, preferably methyl or tertiary alkyl groups and hydroxyl groups, at least one of the radicals $R^{21}$ or $R^{22}$ being a hydroxyl group;

$R^{23}$, $R^{24}$ represent hydrogen, alkyl or alkoxy groups containing up to 9 carbon atoms, preferably methyl or tertiary alkyl groups, cycloalkyl such as cyclopentyl or cyclohexyl, aralkyl such as benzyl or phenyl ethyl or aryl, particularly a phenyl ring, or a group of formula

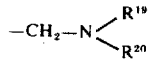

wherein $R^{19}$ and $R^{20}$ have the meaning already indicated above.

The following are examples of suitable compounds:

1) 2-Methyl-6-hydroxy-chroman,
2) 2,2-dimethyl-6-hydroxy-chroman,
3) 2,2,3-trimethyl-6-hydroxy-chroman,
4) 2,2-dimethyl-7-tert.-butyl-6-hydroxy-chroman,
5) 2,2-dimethyl-8-tert.-butyl-6-hydroxy-chroman,
6) 2,2-dimethyl-7-tert.-amyl-6-hydroxy-chroman,
7) 2,2-dimethyl-7-tert.-octyl-6-hydroxy-chroman,
8) 2,2-dimethyl-7-cyclopentyl-6-hydroxy-chroman,
9) 2,2-dimethyl-7-cyclohexyl-6-hydroxy-chroman,
10) 2,2-dimethyl-7-(1-methyl-cyclohexyl)-6-hydroxy-chroman,
11) 2,2-dimethyl-7-(2-phenyl-ethyl)-6-hydroxy-chroman,
12) 2,2-dimethyl-7-(2-methyl-2-phenyl-ethyl)-6-hydroxy-chroman,
13) 2,2-dimethyl-7-phenyl-6-hydroxy-chroman,
14) 2,2,7-trimethyl-6-hydroxy-chroman,
15) 2,2,3,4-tetramethyl-6-hydroxy-chroman,
16) 2,2,5-trimethyl-7,8-dimethoxy-6-hydroxy-chroman,
17) 2,2,5,7,8-pentamethyl-6-hydroxy-chroman,
18) 2-dimethylamino-3,3-dimethyl-5-hydroxy-coumaran,
19) 2-diethylamino-3,3-dimethyl-5-hydroxy-coumaran,
20) 2-pyrrolidino-3,3-dimethyl-5-hydroxy-coumaran,
21) 2-piperidino-3,3-dimethyl-5-hydroxy-coumaran,
22) 2-morpholino-3,3-dimethyl-5-hydroxy-coumaran,
23) 2-morpholino-3,3-dimethyl-6-tert.-butyl-5-hydroxy-coumaran,
24) 2-pyrrolidino-3,3-dimethyl-6-tert.-butyl-5-hydroxy-coumaran,
25) 2-piperidino-3,3-dimethyl-6-tert.-butyl-5-hydroxy-coumaran,
26) 2-morpholino-3,3-dimethyl-6-tert.-octyl-5-hydroxy-coumaran,
27) 2-morpholino-3,3-dimethyl-6-phenyl-5-hydroxy-coumaran,
28) 2-pyrrolidino-3,3-(spiro-cyclohexen-(3)-yl)-5-hydroxy-coumaran,
29) 2-morpholino-3,3-(spiro-cyclohexyl)-5-hydroxy-coumaran,
30) 2-piperidino-3,3-(spiro-cyclohexen-(3)-yl)-5-hydroxy-coumaran,
31) 2-morpholino-3,3-(spiro-3-methyl-cyclohexen-(3)-yl)-5-hydroxy-coumaran,
32) 2-morpholino-3,3-dimethyl-6-morpholinomethyl-5-hydroxy-coumaran,
33) 2-morpholino-3,3-(spiro-4-methyl-cyclohexen-(3)-yl)-5-hydroxy-coumaran,
34) 2-morpholino-3,3-(spiro-4-methyl-cyclohexen-(3)-yl)6-morpholino-methyl-5-hydroxy-coumaran,
35) 2-morpholino-2,3-tetramethylene-5-hydroxy-coumaran,
36) 2,2-dimethyl-7-hydroxy-coumaran,
37) 2,2-dimethyl-6-tert.-butyl-7-hydroxy-coumaran,
38) 2-methoxy-3,3-dimethyl-5-hydroxy-coumaran,
39) 2-methoxy-3,3-dimethyl-6-tert.-octyl-5-hydroxy-coumaran,
40) ethoxy-3,3-dimethyl-5-hydroxy-coumaran,
41) 2-methoxy-3,3-(spiro-4-methyl-cyclohexen-(3)-yl)-5-hydroxy-coumaran,
42) 2-n-butyloxy-3,3-dimethyl-6-tert.-butyl-5-hydroxy-coumaran,
43) Compounds having the following constitution

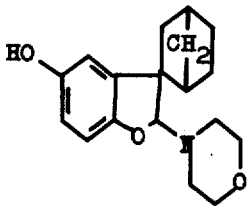

5. Pyrazolidin-3-one derivatives of the following formula:

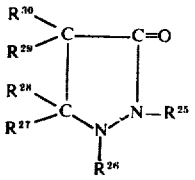

wherein $R^{25}$ represents hydrogen or an acyl group, $R^{26}$ represents hydrogen, alkyl, benzothiazolyl or aryl which may be substituted, for example with lower alkyl or alkoxy groups or halogen, and $R^{27}$, $R^{28}$, $R^{29}$ and $R^{30}$ represent hydrogen, alkyl, or a substituted alkyl or aryl group.

The following compounds have been found to be suitable:

1-Phenyl-pyrazolidin-3-one,
1-(p-tolyl)-pyrazolidin-3-one,
1-phenyl-2-acetyl-pyrazolidin-3-one,
1-phenyl-4-methyl-3-pyrazolidin-3-one,
1-phenyl-5-methyl-3-pyrazolidin-3-one,
1-phenyl-4,4-dimethyl-pyrazolidin-3-one,
1-phenyl-5,5-dimethyl-pyrazolidin-3-one,
1,5-diphenyl-pyrazolidin-3-one,
1-(m-tolyl)-pyrazolidin-3-one
1-(p-tolyl)-5-phenyl-pyrazolidin-3-one,
1-p-chlorophenyl-pyrazolidin-3-one,
1-phenyl-5-phenyl-pyrazolidin-3-one,
1-p-methoxyphenyl-pyrazolidin-3-one,
1-phenyl-2-acetyl-4,4-dimethyl-pyrazolidin-3-one,
1-phenyl-4,4-dimethyl-pyrazolidin-3-one,
1-m-aminophenol-4-methyl-4-n-propyl-pyrazolidin-3-one,
1-o-chlorophenyl-4-methyl-4-ethyl-pyrazolidin-3-one,
1-m-acetamidophenyl-4,4-diethyl-pyrazolidin-3-one,
1-p-chlorophenyl-4-methyl-4-ethyl-pyrazolidin-3-one,
1-p-acetamidophenyl-4,4-diethyl-pyrazolidin-3-one,
1-(p-β-hydroxyethylphenyl)-4,4-dimethyl-pyrazolidin-3-one,
1-p-hydroxyphenyl-4,4-dimethyl-pyrazolidin-3-one,
1-p-methoxyphenyl-4,4-diethyl-pyrazolidin-3-one,
1-p-tolyl-4,4-diethylpyrazolidin-3-one,
1-(7-hydroxy-2-naphthyl)-4-methyl-4-n-propyl-pyrazolidin-3-one,
1-p-diphenylyl-4,4-dimethylpyrazolidin-3-one,
1-(p-β-hydroxyethylphenyl)pyrazolidin-3-one, 1-o-tolyl-pyrazolidin 3-one,
1-o-tolyl-4,4-dimethyl-pyrazolidin-3-one,
1-(2'-benzothiazolyl)-pyrazolidin-3-one,
1-phenyl-4,4-dihydroxymethyl-pyrazolidin-3-one,
1-phenyl-4,4-dimethyl-5-methoxy-pyrazolidin-3-one,
1-phenyl-4,4-dimethyl-5-ethoxy-pyrazolidin-3-one,
1-phenyl-4,4-dimethyl-5-n-propoxy-pyrazolidin-3-one,
1-phenyl-4,4-dimethyl-5-isopropoxy-pyrazolidin-3-one,
1-phenyl-4,4-dimethyl-5-benzyloxy-pyrazolidin-3-one,
1-phenyl-4,4-dimethyl-5-phenoxy-pyrazolidin-3-one,
1-(p-tolyl)-4,4-dimethyl-5-methoxy-pyrazolidin-3-one,
1-(p-tolyl)-4,4-dimethyl-5-ethoxy-pyrazolidin-3-one,
1-(p-tolyl)-4,4-dimethyl-5-n-propoxy-pyrazolidin-3-one,
1-(p-tolyl)-4,4-dimethyl-5-isopropoxy-pyrazolidin-3-one,
1-(p-tolyl)-4,4-dimethyl-5-n-butoxy-pyrazolidin-3-one,
1-(p-tolyl)-4,4-dimethyl-5-benzyloxy-pyrazolidin-3-one,
1-phenyl-4-methyl-4-hydroxymethyl-pyrazolidin-3-one,
1-phenyl-4-ethyl-4-hydroxymethyl-pyrazolidin-3-one,
1,4-dimethyl-pyrazolidin-3-one,
4-methyl-3-pyrazolidin-3-one,
4,4-dimethyl-pyrazolidin-3-one,
1-(2-trifluoroethyl)-4,4-dimethyl-3-pyrazolidone,
5-methyl-3-pyrazolidone, The above compounds may be prepared by the processes described in British Patent Specifications No. 679,677 and 679,678, the "phenimines" which can be obtained by reacting acrylonitrile derivatives with the corresponding hydrazine compounds being saponified to 3-pyrazolidones.

3-Pyrazolidones may also be prepared by the process described in British Pat. Specification No. 703,669 in which the final products are obtained by direct condensation of esters of acrylic acid or derivatives thereof with hydrazines. This process is particularly suitable for reactions with hydrazine itself. The 3-pyrazolidones obtained by this process which have an oily consistency can be obtained in the form of crystalline compounds by converting them into their salts such as their sulphates or 1,5-naphthalene disulfonates. The preparation of 4,4-dialkyl-3-pyrazolidones has been described in U.S. Pat. No. 2,772,282. In this case, 2,2-dialkyl-$\beta$-chloropropionic acid chlorides are reacted with hydrazines.

6. Indandione derivatives

Suitable compounds have been described in British Pat. Application No. 55092/70, e.g.

2-phenyl-1,3-indandione,
1,3-indandione.

7. Amino-9,10-dihydroacridine derivatives. The following are suitable examples:

3,6-bis-(benzylamino)-9,10-dihydro-9-methylacridine,
3,6-bis-(diethylamino)-9-hexyl-9,10-dihydroacridine,
3,6-bis-(diethylamino)-9,10-dihydro-9-methylacridine,
3,6-bis-(diethylamino)-9,10-dihydro-9-phenylacridine,
3,6-diamino-9-hexyl-9,10-dihydroacridine,
3,6-diamino-9,10-dihydro-9-methylacridine;
3,6-diamino-9,10-dihydro-9-phenylacridine,
3,6-bis-(dimethylamino)-9-hexyl-9,10-dihydroacridine.

8. Pyrazolin-5-one derivatives

The preferred pyrazolin-5-one derivatives are those which contain at least one hydrogen in the 5-position or a 4-aminophenylamino group.

Pyrazolin-5-one compounds of the following formula, which have been described in German Pat. Specification (P 2 020 936), are preferred:

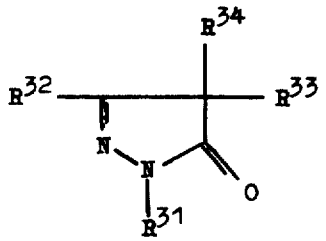

In this formula, $R^{31}$ = (1) hydrogen, (2) a saturated or olefinically unsaturated aliphatic group which preferably contains up to 6 carbon atoms and which may be substituted, e.g. with phenyl as in the benzyl group, with nitril, with halogen e.g. fluorine, with an amino group which may itself be substituted, e.g. an alkylated amino group, particularly dialkylamino, the alkyl substituent of the amino group preferably containing up to 3 carbon atoms, (3) an aryl group, particularly a group of the phenyl series, the aryl ring being optionally substituted, e.g. with an alkyl or alkoxy group which preferably contains up to 5 carbon atoms, with halogen such as fluorine, chlorine or bromine, nitro, amino groups, substituted amino groups, e.g. amino groups substituted with alkyl or acyl groups, particularly with acyl groups which can be derived from aliphatic carboxylic acids, phenoxy groups or alkoxy carbonyl groups, (4) a heterocyclic group, e.g. a ring of the furan, pyridine oxazole, thiazole or imidazole series or a group of the condensed heterocyclic series obtained from the above series by condensation with an aromatic ring system, or (5) cycloalkyl such as cyclohexyl or cyclopentyl;

$R^{32}$ = (1) hydrogen, (2) a saturated or olefinically unsaturated aliphatic group which contains up to 18 carbon atoms and which may itself contain substituents, e.g. phenyl as in the case of a benzyl- or phenyl ethyl group, halogen such as fluorine, chorine or bromine, alkoxycarbonyl, hydroxyl or alkoxy, (3) aryl, particularly a group of the phenyl series, the aryl ring being optionally substituted, e.g. with an alkyl or alkoxy group which preferably contains up to 5 carbon atoms, halogen such as chlorine or bromine, hydroxyl, nitro or acyl, (4) a heterocyclic group, in particular a ring of the pyridine, furan, thiophene, pyrrole, oxazole, thiazole or imidazole series, (5) cycloalkyl such as cyclohexyl or cyclopentyl, (6) alkoxycarbonyl groups containing up to 18 carbon atoms, (7) a hydroxyl group which may be etherified, particularly with aliphatic radicals containing up to 18 carbon atoms, (8) amino which may be substituted, e.g. with alkyl or acyl groups, particularly those derived from aliphatic carboxylic acids which have up to 18 carbon atoms, or with benzoyl, (9) a carbamic acid ester group, in particular one which contains aliphatic ester groups with up to 18 carbon atoms, or (10) a carbamoyl group in which the amide group may be substituted, e.g. with an alkyl group containing up to 5 carbon atoms;

$R^{33}$ = (1) hydrogen, (2) a saturated or an olefinically unsaturated aliphatic group which contains up to 18 carbon atoms and which may be substituted, e.g. with phenyl as in the case of benzyl or phenyl ethyl groups or with halogen as chlorine or bromine, with nitrile, alkoxy or amino groups which may in turn be substituted, e.g. with alkyl or phenyl, e.g. unsubstituted phenyl, dialkylaminophenyl or sulfophenyl, carbamoyl, alkoxycarbonyl, piperidyl or the like, (3) aryl, in particular a group of the phenyl series in which the aryl ring may itself be substituted, e.g. with an alkyl or alkoxy group which preferably has up to 5 carbon atoms, nitro, nitrile, alkoxycarbonyl or carbamoyl, (4) amino in which the amino groups may be substituted, e.g. with alkyl groups which preferably have up to 5 carbon atoms, cycloalkyl, phenyl or acyl, particularly acyl groups of those aliphatic carboxylic acids which contain up to 18 carbon atoms, or benzoyl, (5) alkoxy with preferably up to 5 carbon atoms which may in turn be substituted like the aliphatic group described above, or (6) halogen, e.g. chlorine or bromine; in cases where $R^{34}$ is hydrogen, $R^{33}$ may also represent an alkylene chain between two pyrazolone rings of the above formula;

$R^{34}$ = hydrogen or a 4-amiinophenylamino group or 4-dialkylaminophenylamino group.

Furthermore, $R^{32}$ and $R^{33}$ may together represent the ring members required for completing a 5-membered or 6-membered carbocyclic or heterocyclic ring.

The following are examples of suitable compounds:

1-Phenyl-3,4-dimethyl-4-(N,N-diethyl-p-phenyleneamino)-pyrazolin-5-one,
1-phenyl-3-methyl-4-isopropylidene-pyrazolin-5-one,
1-phenyl-2,3-dimethyl-4-diethylamino-pyrazolin-5-one,
1-phenyl-3-methyl-4-(N,N-diethylaminomethyl)-pyrazolin-5-one,
1,6-hexamethylene-bis-(1-phenyl-3-methyl-pyrazolin-5-one-4-carboxylic acid amide),
1-(4-methyl-3-methoxy-phenyl)-3-(N-hexadecanoylamino)-pyrazolin-5-one,
1-phenyl-3-acetylamino-pyrazolin-5-one,
1-phenyl-3-propionylamino-pyrazolin-5-one,
1-phenyl-3-dodecanoylamino-pyrazolin-5-one,
1-phenyl-3-ethoxycarbonylamino-pyrazolin-5-one,
1-phenyl-3-ethoxycarbonyl-pyrazolin-5-one.

The pyrazolin-5-one derivatives are prepared by methods known from the literature. Reference may be made, for example, to the monograph of R. H. and Wiley "Pyrazolones, Pyrazolidones and Derivatives" (1964) and to German Patent Specification No. 1,155,675.

9. Ascorbic acid and 6-ascorbic acid esters as described in U.S. Pat. No. 1,728,661.

The following are examples of suitable compounds:

Ascorbic acid,
6-ascorbyl-palmitate,
6-ascorbyl-laurate,
6-ascorbyl-stearate,
6-ascorbyl-benzoate,
6-ascorbyl-6-palmitate-5-β-carboxy-propionate.

10. Acetonitrile derivatives as described in German Offenlegungsschrift No. 2,010,837, for example the following:

Phenylacetoacetonitrile,
phenylbenzoacetonitrile,
p-chlorophenylacetoacetonitrile.

11. Hydroxylamine derivatives, particularly compounds of the following general formula:

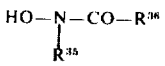

in which $R^{35}$ represents hydrogen or an alkyl group preferably containing up to 4 carbon atoms and $R^{36}$ represents an alkoxy group with up to 5 carbon atoms, aryloxy, preferably phenyloxy, amino, an alkylamino group with preferably up to 18 carbon atoms, arylamino, particularly phenylamino and in which the phenyl ring may in turn carry substituents, e.g. halogen such as fluorine or chlorine, alkyl with preferably up to 3 carbon atoms, alkoxy, cyano and the like.

The following compounds have been found to be suitable:

N-Allyl-N'-hydroxyurea,
N-butyl-N'-hydroxy-N'-methylurea,
N-hydroxy-carbamic acid ethyl ester,
N-dodecyl-N'-hydroxyurea,
N-dodecyl-N'-hydroxy-N'-methylurea,
N-octadecyl-N'-hydroxyrea,
N-phenyl-N'-hydroxyurea,
N-(3,4-dichlorophenyl)-N'-hydroxyurea,
N-α-naphthyl-N'-hydroxyurea,
N-hydroxycarbamic acid phenyl ester,
N-(3,4-dichlorophenyl)-N'-hydroxy-N'-methyl urea,
N-phenyl-N'-hydroxy-N'-methylurea and
N-(4-chlorophenyl)-N'-hydroxy-N'-methylurea.

The above compounds are known per se and they may be prepared by methods described in the literature, especially those describedi in German Auslegeschriften No. 1,127,344 and 1,129,151.

So-called toner substances which shift the colour tone of the silver image in the direction of black or blueblack and which accelerate development when combined with certain reducing agents, e.g. with phenols, may be added to the light sensitive material, for example the known toners 2H-phthalazinone-(1) and 2-acyl-2H-phthalazinone-(1) derivatives which have been described in U.S. Pat. No. 3,080,254 and 3,446,648.

The toners may, like the reducing agents, be added either as solid substances or as solutions in organic solvents to the casting solutions during or after grinding or to an adjacent layer. They may be used in concentrations of 0.3 to 6, preferably 0.5 to 6 mols per mol of silver salt, preferably 1 to 4 mols per mol of silver salt. They may also be used as combinations of various toners.

The following compounds are examples of suitable toners:

2H-Phthalazinone-(1),
2-pivalyl-2H-phthalazinone-(1),
2-acetyl-2H-phthalazinone-(1),
4-hydroxy-phthalic acid imide,
4-methoxy-phthalic acid imide,
phthalic acid imide, 4-ethoxy-phthalic acid imide,
4-tert.-butyl-phthalic acid imide,
4-methyl-phthalic acid imide,
3-methyl-phthalic acid imide,
4,5-dimethyl-phthalic acid imide,
4-styryl-phthalic acid imide,
4-propoxy-phthalic acid imide,
4-cyclohexoxy-phthalic acid imide.

The binding agents used for preparing the material according to the invention may be organic polymers such as copolymers of vinyl chloride and vinyl acetate or of butadiene and styrene, polyethylene, polyamides, polyisobutylene, polyvinyl chloride, polyvinylidene chloride, polyvinylpyrrolidone, polystyrene, chlorinated rubber, polyvinylbutyral, polymers of acrylic or methacrylic acid esters or copolymers of derivatives of acrylic and methacrylic acid, cellulose derivatives such as nitrocellulose, cellulose acetates, cellulose propionates or mixtures thereof such as cellulose acetobutyrates.

The light sensitive layer may be used as a selfsupporting layer but is preferably applied to a suitable support layer. The support layer must be stable at the operating temperature of between 60 and 200°C. Suitable support layers are e.g. sheets or foils of papers, cellulose acetate, polyethylene terephthalate, textile fabrics, metal foils or glass. In the case of paper supports, the paper may contain the usual auxiliary layers such as baryta layers, polyethylene layers, etc..

It has generally been found sufficient to use a proportion by weight of binder to silver salt and other additives of between 1:4 and 1:1.

The thickness of the light sensitive layer may also be adapted to the requirements of the particular reproduction process. Layer thicknesses of between 5 and 100 G2zm are generally sufficient for ordinary requirements. The support layers have the usual thicknesses of between 0.1 and 0.8 mm.

The light sensitive material may contain the usual white pigments, e.g. silicon dioxide, barium sulfate, titanium dioxide and zinc oxide.

The photographic materials according to the invention are processed by known methods. Imagewise exposure is carried out with the usual light sources used in photography, e.g. mercury, quartz iodine or simple incandescent lamps. The choice of light source depends on the spectral sensititivy of the material according to the invention. The exposure time is a few seconds.

The exposed material is then heated uniformly to a temperature of between about 60° and 160°C. The time and temperature required for the heat treatment depend on the structure of the material according to the invention and between 3 and 80 seconds is generally sufficient. The image obtained is generally dark brown to black and is immediately ready for use.

The images obtained by the procedure described above are, of course, negative copies of the original. Positive copies can be produced by a transfer process. In that case, reducing agents which are transferable in the heat are used in the light sensitive layer, and heating is carried out in contact with the receptor layer after imagewise exposure of the light sensitive material. The image receiving layer contains reactants which are capable of undergoing a color forming reaction with the reducing agents transferred from the unexposed areas. The reactants used for this purpose may be e.g. the same silver salts of organic acids as those which are normally present in the light sensitive layer.

EXAMPLE 1

A light sensitive material is prepared by grinding a mixture of the following composition:

1.8 g of a mixture of silver behenate and behenic acid (molar ratio 1:1),
1 g of 2H-phthalazinone-(1),
2 g of polyvinyl acetate and
70 g of methyl ethyl ketone for 16 hours in a ball mill, stirring the resulting suspension together with a solution of 1 g of bis-(2-hydroxy-3-tert.-butyl-5-methylphenyl)methane and
1 mg of sensitizer in
30 ml of methyl ethyl ketone, applying the casting solution to a paper support and drying. The amount of silver applied is 0.3 to 0.4 g/m².

The material according to the invention is exposed for 30 seconds behind a $\sqrt{2}$ step wedge in a conventional copying apparatus equipped with tungsten filament lamps and then developed by heating to 82°C for 15 seconds. Brown or brownish black copies of the wedge are obtained.

| Sensitizer No. | Sensitivity in steps $\sqrt{2}$ |
|---|---|
| none | 0 |
| 86 | 23 |
| 101 | 25 |
| 102 | 24 |

EXAMPLE 2

A light-sensitive material is prepared as described in Example 1 except that mercury-II acetate is added in the casting solution. When the material is processed in a manner analogous to Example 1, the copies obtained have a higher density and less fog than those obtained without the addition of mercury acetate.

| Sensitizer No. | Hg(II) acetate mg per sample | Sensitivity in steps $\sqrt{2}$ |
|---|---|---|
| 101 | 5 | 26 |
| 102 | 5 | 25 |
| 101 | 10 | 25 |
| 101 | 30 | 25 |
| 101 | 70 | 23 |
| 101 | 150 | 16 |

EXAMPLE 3

A light sensitive material is prepared by grinding 1.8 g of silver behenate/behenic acid (molar ratio 1:1),
1 g of 2H-phthalazinone-(1),
0.005 g of mercury(II) acetate,
2 g of polyvinyl acetate
70 ml of methyl ethyl ketone in a ball mill, adding a solution of 1 g of bis-(2-hydroxy-3-tert.-butyl-5-methylphenyl)methane and
0.001 g of a sensitizer selected from the following table in 30 ml of methyl ethyl ketone, casting on paper and drying.

The light sensitive layers are exposed for 30 seconds behind a step wedge, using a source of light containing tungsten filament lamps and having an intensity of illumination of 50,000 lux, and the layers are then developed as described in Example 1. In the following Table, the sensitivities obtained are compared with that of a layer which is free from sensitizer.

| Sensitizer No. | Relative sensitivity |
|---|---|
| none | 1 |
| 93 | 250 |
| 96 | 2000 |
| 128 | 380 |
| 130 | 1000 |
| 126 | 1000 |
| 125 | 500 |
| 76 | 1500 |
| 51 | 1000 |
| 58 | 380 |
| 59 | 500 |
| 167 | 130 |
| 124 | 190 |
| 87 | 500 |
| 30 | 250 |
| 12 | 190 |
| 163 | 16 |
| 2 | 50 |
| 159 | 95 |

EXAMPLE 4

A light-sensitive material is prepared as in the preceding examples from a casting solution of the following composition:

1.8 g of silver behenate/behenic acid (molar ratio 1:1)
1 g of 2H-phthalazinone-(1)
0.005 g of mercury(II) acetate
1 g of bis-(2-hydroxy-3-tert.-butyl-5-methylphenyl)methane
0.0005 g of a sensitizer from the following table
1 g of polyvinyl acetate and
100 ml of methyl ethyl ketone.

The light-sensitive materials are exposed to a 1000 Watt quartz iodine lamp at a distance of 30 cm behind a graded interference filter (Schott's Veril Filter) provided with a step wedge, and is then developed by heat as described in Example 1. The spectrograms obtained show the spectral sensitivity obtained in dependence on the given sensitizer. The results are shown in the Table below.

| Sensitizer No. | Spectral sensitivity in nm Maximum | Range |
|---|---|---|
| none | — | — |
| 1 | 450 | 410–470 |
| 2 | 450 | 410–470 |
| 3 | 450 | 410–470 |
| 4 | 460 | 420–480 |
| 5 | 530 | 490–550 |
| 6 | 545 | 500–590 |
| 7 | 550 | 500–590 |
| 8 | 590 | 520–620 |
| 9 | 520 | 480–550 |
| 10 | 550–560 | 500–600 |
| 11 | 520 | 450–540 |
| 12 | 540 | 470–570 |
| 13 | 505 | 450–530 |
| 14 | 515 | 460–530 |
| 15 | 520 | 460–540 |
| 16 | 525 | 475–550 |
| 17 | 520 | 470–540 |
| 18 | | 530–560 |
| 19 | 555 | 490–580 |
| 20 | 590 | 520–610 |
| 21 | 585 | 510–600 |
| 22 | 585 | 520–610 |

-continued

| Sensitizer No. | Spectral sensitivity in nm Maximum | Range |
|---|---|---|
| 23 | 610 | 550–640 |
| 24 | 570 | 510–600 |
| 25 | 585 | 520–610 |
| 26 | 580–590 | 520–600 |
| 27 | 585 | 520–610 |
| 28 | | 600–650 |
| 29 | 610 | 500–635 |
| 30 | 660 | 580–680 |
| 31 | 680–690 | 620–710 |
| 32 | 720–730 | 650–740 |
| 33 | 445 | 410–470 |
| 34 | 430 | 390–460 |
| 35 | 450 | 410–470 |
| 36 | 470 | 430–490 |
| 37 | 435 | 400–460 |
| 38 | 440 | 400–470 |
| 39 | 415 | 400–430 |
| 40 | 440 | 415–465 |
| 41 | 450 | 410–480 |
| 42 | 435 | 400– 460 |
| 43 | 435 | 400–465 |
| 44 | 435 | 400–460 |
| 45 | 435 | 400–460 |
| 46 | 435 | 390–470 |
| 47 | 435 | 390–460 |
| 48 | 455 | 410–470 |
| 49 | 480 | 430–520 |
| 50 | 485 | 420–520 |
| 51 | 485 | 420–520 |
| 52 | 470 | 410–500 |
| 53 | 470 | 410–500 |
| 54 | 470 | 400–500 |
| 55 | 495 | 430–525 |
| 56 | 495 | 430–525 |
| 57 | 495 | 430–525 |
| 58 | 495 | 430–525 |
| 59 | 460 | 430–480 |
| 60 | 465 | 410–500 |
| 61 | 465 | 400–500 |
| 62 | 460 | 410–490 |
| 63 | 460 | 410–490 |
| 64 | 462 | 420–480 |
| 65 | 460 | 410–490 |
| 66 | 435 | 400–460 |
| 67 | 450 | 400–480 |
| 68 | 450 | 400–480 |
| 69 | 470 | 415–500 |
| 70 | 465 | 420–490 |
| 71 | 465 | 420–490 |
| 72 | 470 | 430–490 |
| 73 | 470 | 410–500 |
| 74 | 480 | 420–520 |
| 75 | 460–470 | 410–490 |
| 76 | 490 | 430–520 |
| 77 | 425 | 400–450 |
| 78 | 505 | 460–530 |
| 79 | 500–520 | 450–540 |
| 80 | 490 | 440–510 |
| 81 | 530 | 470–560 |
| 82 | 490 | 430–520 |
| 83 | 490 | 440–520 |
| 84 | 480 | 430–520 |
| 85 | 495 | 430–530 |
| 86 | 495 | 430–530 |
| 87 | 530 | 470–560 |
| 88 | 480–490 | 430–510 |
| 89 | 490 | 410–530 |
| 90 | 520 | 470–550 |
| 91 | 555 | 470–610 |
| 92 | 490 | 440–520 |
| 93 | 510 | 450–540 |
| 94 | 505 | 430–550 |
| 95 | 510 | 440–530 |
| 96 | 545 | 470–580 |
| 97 | | 430–550 |
| 98 | 540 | 470–570 |
| 99 | 520 | 450–550 |
| 100 | 525 | 460–550 |
| 101 | 525 | 450–550 |
| 102 | 535 | 470–550 |
| 103 | 520 | 450–550 |
| 104 | 520 | 460–550 |
| 105 | 525 | 460–550 |
| 106 | 520 | 450–550 |
| 107 | 520 | 450–550 |
| 108 | 540 | 470–570 |
| 109 | | 510–590 |
| 110 | | 530–620 |
| 111 | 525 | 460–550 |
| 112 | 530 | 470–560 |
| 113 | 530 | 470–560 |
| 114 | 530 | 480–560 |

-continued

| Sensitizer No. | Spectral sensitivity in nm Maximum | Range |
|---|---|---|
| 115 | 520 | 450–560 |
| 116 | 525 | 460–560 |
| 117 | 525 | 470–550 |
| 118 | 525 | 460–560 |
| 119 | 535 | 470–560 |
| 120 | 535 | 470–560 |
| 121 | 535 | 470–570 |
| 122 | 535 | 480–560 |
| 123 | 530 | 470–560 |
| 124 | 530 | 470–560 |
| 125 | 535 | 470–560 |
| 126 | 535 | 470–560 |
| 127 | 510–530 | 450–550 |
| 128 | ca. 570 | 500–600 |
| 129 | 610–620 | 530–640 |
| 130 | ca. 530 | 450–570 |
| 131 | 520 | 460–550 |
| 132 | ca. 520 | 440–570 |
| 133 | ca. 570 | 510–600 |
| 134 | 550 | 460–590 |
| 135 | 555 | 480–590 |
| 136 | ca. 550 | 480–590 |
| 137 | | 490–580 |
| 138 | 560–570 | 510–610 |
| 139 | ca. 590 | 540–620 |
| 140 | 610–620 | 520–640 |
| 141 | | ca.500–620 |
| 142 | | ca.500–620 |
| 143 | | 500–620 |
| 144 | 590 | 520–620 |
| 145 | 535 | 420–580 |
| 146 | 475–480 | 400–500 |
| 147 | 490 | 420–520 |
| 148 | ca. 530 | 400–570 |
| 149 | 475 | 410–510 |
| 150 | 530 | 460–550 |
| 151 | 530 | 460–550 |
| 152 | 530 | 460–550 |
| 153 | 530 | 450–570 |
| 154 | 530 | 470–550 |
| 155 | 590 | 510–620 |
| 156 | | 650–750 |
| 157 | 690 | 600–740 |
| 158 | 540 | 480–570 |
| 159 | 485 | 410–540 |
| 160 | | 440–560 |
| 161 | | 470–630 |
| 162 | | 480–600 |
| 163 | 520 | 430–570 |
| 164 | 520–530 | 470–560 |
| 165 | ca. 560 | 410–640 |
| 166 | 460 | 400–510 |
| 167 | 460 | 400–520 |
| 168 | 430 | 400–460 |
| 170 | 695 | 400–730 |
| 171 | 550 | 450–610 |
| 173 | 615 | 530–670 |
| 174 | 615 | 560–660 |
| 175 | 580 | 490–620 |
| 176 | 475 | 430–520 |
| 177 | 450 | 410–490 |
| 178 | 555 | 480–590 |

EXAMPLE 5

A light-sensitive material is prepared as described in Example 1 but the heavy metal compounds and sensitizers listed in the following table are added to the casting solution in the quantities indicated there. Processing is carried out as described in Example 1. The copies in all cases have aa higher density than without the addition of the heavy metal compound.

| Quantity in mg | Heavy metal compound | Sensitizer in mg | No. |
|---|---|---|---|
| 10 | Mercury(II) adipate | 1 | 102 |
| 5 | Bis-(3-methoxypropyl-mercury(II) oxalate | 1 | 102 |
| 5 | Bis-(2-ethoxyethyl-mercury(II) tartrate | 1 | 102 |

-continued

| Quantity in mg | Heavy metal compound | Sensitizer in mg | No. |
|---|---|---|---|
| 5 | (9-Methoxy-1-carboxy-heptadecyl-(8))-mercury(II) acetate | 1 | 102 |
| 50 | Mercury(II) adipate | 1 | 86 |
| 5 | Mercury(II) succinate | 1 | 86 |
| 65 | N-phthalimide-mercury(II) acetate | 1 | 86 |
| 60 | 1-Benzotriazolyl-mercury(II) acetate | 1 | 86 |
| 65 | Compound No. 3 in Table 3 | 1 | |
| 90 | 3-(Phenyl-mercury(II))-8-hydroxy-quinoline | 1 | 86 |
| 55 | 4-Aminophenyl-mercury(II) acetate | 1 | 94 |
| 70 | Compound No. 1 in Table 3 | 1 | |
| 75 | Bis-(2H-1-oxo-phthalazinyl-2)-mercury(II) | 1 | 58 |
| 60 | 1-Benzotriazolyl-mercury(II) acetate | 1 | 125 |
| 30 | Uranyl acetate | 1 | 86 |
| 3 | 1,1-Bis-(benzotriazolyl)-mercury(II) | 1 | 102 |
| 50 | N,N'-Bis-(succinimide)-mercury(II) | 1 | 102 |
| 15 | Compound No. 10 of Table 3 | 1 | 102 |
| 25 | Compound No. 13 of Table 3 | 1 | 102 |
| 3 | Mercury(II)-di-hexadecylsulfide | 1 | 102 |

EXAMPLE 6

A light-sensitive material is prepared as described in Example 1 but, before the components are ground, 5 mg of mercury-II acetate and the heavy metal compounds and sensitizers shown in the Table below are added to the casting solutions. Processing is carried out as described in Example 1. The copies have a higher density and a more neutral image tone then copies obtained without the addition of these heavy metal compounds.

| Quantity in mg | Heavy metal compound No. | Sensitizer Quantity in mg | No. |
|---|---|---|---|
| 5 | Uranyl acetate | 1 | 86 |
| 10 | Cadmium(II) acetate | 1 | 86 |
| 10 | N-(2H-1-oxo-phthalazinyl-(2))-silver | 1 | 102 |
| 10 | Bis-(2H-1-oxo-phthalazinyl-(2))-nickel(II) | 1 | 102 |
| 10 | N-phthalimide-silver | 1 | 102 |
| 5 | Cadmium(II) stearate | 1 | 102 |
| 10 | N,N'-bis-phthalimide-lead(II) | 1 | 102 |

EXAMPLE 7

A light-sensitive material is prepared as described in Example 3 but with the addition of 1 mg of sensitizer No. 86 and using 1.8 g of silver behenate/behenic acid (molar ratio 1:1) which contains 0.013 mol-% of cadmium behenate. Processing is carried out as described in Example 1. The copies have a higher density and a more neutral image tone than those obtained when using a silver behenate/behenic acid compound which has been prepared without the addition of the cadmium salt.

The same result is obtained when using 1.8 g of silver behenate/behenic acid (molar ratio 1:1) containing 0.45 mol-% of lead behenate.

The silver behenate/behenic acid compounds which contain heavy metal are prepared by precipitating an equimolecular mixture of sodium behenate and behenic acid in aqueous-alcoholic solution with a silver nitrate and cadmium(II) nitrate or lead(II) nitrate mixture in water.

EXAMPLE 8

A light-sensitive material is prepared by grinding a mixture of the following composition for 18 hours:

3.6 g of silver behenate/behenic acid (molar ratio 1:1), 2 g of 2H-phthalazinone-(1), mg of mercury(II) acetate (for quantity see following Table), 3 g of cellulose acetobutyrate, 1.5 g of a copolymer of polyvinyl chloride and polyvinyl acetate, 52 g of methyl ethyl ketone.

A solution of sensitizer and developer (for quantities and compound see following Table) in methyl ethyl ketone is added to the suspension with stirring.

The casting solution is applied to a paper support and dried. The amount of silver applied is 0.3 to 0.4 g of silver in the form of the silver compound per $m^2$. The material is exposed for 30 seconds behind a step wedge with a gradient of $\sqrt{2}$ in a conventional copying apparatus equipped with tungsten filament lamps and then developed by heating under the conditions indicated in the following Table. Brown to black images with a high density are obtained.

| Hg(II) acetate mg | Sensitizer No. | Sensitizer mg | Developer | g | Development Temperature °C | Development Time in sec | Colour of silver image | Sensitivity in steps $\sqrt{2}$ |
|---|---|---|---|---|---|---|---|---|
| 100 | 86 | 1 | Bis-(2-hydroxy-3-tert.butyl-5-methylphenyl)-methane | 2 | 83 | 20 | brownish black | 21 |
| 10 | 101 | 2 | Bis-(2-hydroxy-3-tert.-butyl-5-methylphenyl)-methane | 2 | 83 | 20 | black | 26 |
| 100 | 86 | 1 | pyrocatechol | 0.7 | 83 | 10 | brown/black | 19 |
| 100 | 86 | 1 | hydroquinone | 0.6 | 83 | 5 | " | 21 |
| 10 | 101 | 2 | 2-Octylhydroquinone | 1.2 | 80 | 5 | " | 26 |
| 10 | 101 | 2 | 2,5-di-tert.-butyl-hydroquinone | 1.3 | 83 | 5 | " | 26 |
| 10 | 130 | 1 | 2,5-di-hexyloxy-hydroquinone | 1.8 | 80 | 5 | dark brown | 22 |
| 10 | 130 | 2 | 2-tetradecyl-5-(9-carboxy-nonyl) hydroquinone | 2.8 | 83 | 5 | black | 22 |
| 10 | 101 | 2 | 2-ethoxycarbonyl-hydroquinone | 1.6 | 94 | 40 | dark brown | 24 |
| 100 | 86 | 1 | homogantisic acid-N,N-diethyl amide | 1.3 | 83 | 20 | blue black | 20 |
| 100 | 86 | 1 | 2-(1,4-dihydroxyphenyl)-5-(1-phenyltetrazolyl)-sulfide | 1.8 | 83 | 10 | black | 19 |
| 100 | 86 | 1 | 2,6-dicyclopentyl-p-cresol | 1.4 | 98 | 20 | " | 19 |
| 10 | 130 | 1 | 2-tert.-butyl-5-cyclopentyl-p-cresol | 1.4 | 94 | 40 | black | 21 |
| 10 | 130 | 1 | 2-tert.butyl-5-cyclohexyl-p-cresol | 1.4 | 94 | 40 | " | 22 |
| 100 | 86 | 1 | 2-iso-propyl-p-cresol | 0.9 | 98 | 40 | " | 21 |
| 10 | 130 | 1 | 1,1,5,5-tetra(2-hydroxy-3,5-dimethylphenyl)-2,4-diethyl pentane | 3.6 | 88 | 20 | " | 20 |
| 10 | 130 | 1 | 1,1-bis-(2-hydroxy-3,5-dimethyl-phenyl)-2-methylpropane | 3.4 | 88 | 40 | " | 24 |
| 10 | 130 | 1 | bis-(2-hydroxynaphthyl-(1))-methane | 1.8 | 94 | 40 | dark grey | 25 |
| 10 | 130 | 1 | 1-hydroxy-5-methoxy-naphthalene | 1 | 83 | 40 | black | 25 |
| 10 | 130 | 1 | 2,2'-dihydroxy-dinaphthyl | 1.7 | 98 | 20 | brown | 21 |
| 10 | 130 | 1 | 2,3-dihydroxynaphthalene | 1 | 88 | 40 | black | 25 |
| 100 | 86 | 1 | N-(2-hydroxyphenyl)-N'-dodecyl urea | 2 | 83 | 40 | blue black | 22 |
| 100 | 86 | 1 | 2-dodecanoyl-amino-phenol | 1.7 | 83 | 40 | brown black | 20 |
| 10 | 101 | 2 | 4-hydroxyphenyl-carbamic acid ethyl ester | 1.1 | 98 | 40 | black | 25 |
| 10 | 101 | 1 | 4-isopropylidene-aminophenol | 1.2 | 83 | 20 | brown black | 22 |
| 10 | 101 | 1 | N-(4-hydroxy-3,5-tert.-butyl-phenyl)-N'-octadecyl-urea | 2.5 | 83 | 40 | blue black | 22 |
| 10 | 130 | 1 | 6-dimethylamino-3-hydroxytoluene | 1.2 | 88 | 20 | brown black | 23 |
| 100 | 86 | 1 | 2-methoxy-3,3'-dimethyl-5-hydroxy-coumaran | 1.2 | 94 | 40 | black | 20 |
| 100 | 86 | 1 | 2-morpholino-3,3-(spiro-3-methyl-cyclohexen-(3)-yl)-5-hydroxy-coumaran | 2.0 | 98 | 20 | brown | 20 |
| 10 | 86 | 1 | 2-ethoxy-3,3-dimethyl-5-hydroxy-coumaran | 1.5 | 98 | 20 | " | 20 |
| 10 | 86 | 1 | 2,2-dimethyl-6-hydroxy-chroman | 1.0 | 88 | 20 | brown black | 19 |
| 10 | 101 | 2 | 1,2-bis-(2-hydroxy-3-tert.-butyl-dibenzofuryl)-ethane | 3.0 | 94 | 40 | black | 28 |
| 10 | 101 | 2 | 1-phenyl-3,4-dimethyl-4-N,N-diethyl-p-phenylene-diamino)-pyrazolin-5-one | 2 | 83 | 20 | " | 21 |

EXAMPLE 9

A light sensitive material is prepared by grinding a mixture of the following composition in a vibratory mill for 16 hours:

1.8 g of silver behenate/behenic acid (molar ratio 1:1)

0.75 g of 2H-phthalazinone-(1)

5 mg of mercury(II) acetate 2 g of polyvinyl acetate 70 ml of methyl ethyl ketone.

A solution of 1 mg of sensitizer No. 86 in 30 ml of methyl ethyl ketone and the developers mentioned in the Table below is added to the resulting suspension with stirring.

The casting solution is applied to a paper support and processed as described in Example 1. Brown to black images with high density are obtained.

| Developer | Development g | Development Temperature | Development Time sec. | Colour of image silver | Sensitivity in steps $\sqrt{2}$ |
|---|---|---|---|---|---|
| N-Phenyl-N'-methyl-N'-hydroxy-urea | 0.5 | 83 | 15 | black | 22 |
| N-3,4-dichloro-phenyl-N'-hydroxy-urea | 0.8 | 88 | 80 | brown | 21 |
| N-phenyl-N'-hydroxy-urea | 0.45 | 83 | 10 | grey black | 19 |
| N-naphthyl-N'-hydroxy-urea | 0.6 | 83 | 30 | black | 22 |
| N-dodecyl-N'-methyl-N'-hydroxy-urea | 0.75 | 83 | 40 | " | 21 |

EXAMPLE 10

A light-sensitive material is prepared as described in Example 8 but with the addition of 1 mg of sensitizer No. 86 and using the toners shown in the following Table instead of 2 g of 2H-phthalazinone-(1). The material is processed as described in Example 1.

Whereas only a yellow silver image of low density is obtained without the use of a toner, brown to black images with high density are obtained in the presence of the following toners.

| g per reaction mixture | Toner | Image tone |
|---|---|---|
| 2.4 | 4-Methoxy-phthalimide | black |
| 2.6 | 4-Ethoxy-phthalimide | black |
| 2.0 | Phthalimid | black |
| 2.4 | 4-Styryl-phthalic acid imide | blue black |

EXAMPLE 11

A light-sensitive material is prepared by grinding a mixture of the following composition for 16 hours:

1.8 g of silver stearate,
0.2 g of stearic acid,
10 mg of mercury(II) acetate,
1.5 g of 2H-phthalazinone-(1),
3 g of cellulose acetobutyrate,
1.5 g of a copolymer of vinyl chloride and vinyl acetate (mixed in the ratio of 88:12),
39 g of methyl ethyl ketone.

After the addition of a solution of
2 g of bis-(2-hydroxy-3-tert.-butyl-5-methyl-phenyl)methane and
1 mg of sensitizer No. 86 in
15 g of methyl ethyl ketone, the casting solution is applied to a support layer of paper and dried. The light-sensitive material is exposed and developed as described in Example 1. A black image with high density is obtained. When silver stearate is replaced by a silver stearate which contains 5 mols per cent of cadmium stearate, the material shows no development fog even when developed at a 10° to 15°C higher temperature. Instead of 1.8 g of silver stearate, 1.6 g of silver 2-ethylthio-5-(carboxylatomethylthio)-1,3,4-thiadiazole, 2.1 g of silver 2-decylthio-5-(carboxylatomethythio)1,3,4-thiadiazole or 1.5 g of S-docosyl-thioglycolic acid silver could be used.

EXAMPLE 12

A light-sensitive two-layered material is prepared on a paper support. The casting solutions have the following composition:

First layer:
1.8 g of silver behenate/behenic acid (molar ratio 1:1),
1 g of 2H-phthalazinone-(1),
0.05 g of mercury(II) acetate,
1 g of bis-(2-hydroxy-3-tert.-butyl-5-methyl-phenyl)methane,
0.0005 g of sensitizer No. 126,
2 g of polyvinyl acetate and
100 ml of methyl ethyl ketone.

Second layer (top layer):
2 % solution of polyvinyl butyral in methyl ethyl ketone.

Another two-layered material is prepared with the following casting solutions:

First layer:
1.8 g of silver behenate/behenic acid (molar ratio 1:1),
1 g of 2H-phthalazinone-(1),
0.005 g of mercury(II) acetate,
0.001 g of sensitizer No. 102,
2 g of polyvinyl acetate and
100 ml of methyl ethyl ketone.

Second layer (top layer):
2 g of bis-(2-hydroxy-3-tert.-butyl-5-methyl-phenyl)methane,
5 g of polyvinyl butyral and
50 ml of methanol.

Instead of the last mentioned casting solution for the top layer, a casting solution of the following composition may be used:
2 g of bis-(2-hydroxy-3-tert.-butyl-5-methyl-phenyl)methane,
0.5 g of 2H-phthalazinone-(1),
1 g of polyvinyl acetate and
50 ml of methyl ethyl ketone.

Similarly, other sensitizers and reducing agents may be used instead of the compounds mentioned above.

The light-sensitive two-layered material obtained is exposed in a commercial copy printer or in an enlarger behind a transparent continuous-tone or half-tone original and developed by heating to temperatures of between 85°C and 95°C for 20 to 30 seconds. The copies obtained are similar in quality to those obtained with the single-layered materials described in Examples 2 and 3 but with an excellent high gloss.

EXAMPLE 13

A light-sensitive material is prepared by grinding the following components for 16 hours:
2.3 g of silver 2-(tetradecylthio)-5-(caboxylatomethylthio)-1,3,4-thiadiazole,
10 mg of mercury-II acetate,
2 g of 2H-phthalazinone-(1), 3 g of cellulose acetobutyrate,
1.5 g of a copolymer of vinyl chloride and vinyl acetate (in the ratio of 60:40) and
39 g of methyl ethyl ketone.

After the addition of a solution of
0.65 g of hydroquinone,
1 mg of sensitizer No. 86 and
15 g of methyl ethyl ketone, the casting solution is applied to a paper support and dried. On this layer, a second layer is then applied from the following solution:

5 g of polyvinyl butyral,
0.2 g of 1-phenylpyrazolidin-3-one and
50 ml of methanol and this layer is then dried.

The light-sensitive material is exposed to light and processed as described in Example 1. A dark brown image of the original is obtained.

Similar results are obtained when one of the following silver salts is used instead of the silver salts mentioned above:

1.5 g of silver (3-carboxylatomethylthio)-1,2,4-triazole,
1.5 g of octadecyl-thioglycolic acid silver,
2.0 g of silver 2-(octadecylthio)-5-(carboxylatomethylthio)-1,3,4-thiadiazole,
1.7 g of silver 2-(hexylthio)-5-(carboxylatomethylthio)1,3,4-thiadiazole.

We claim:

1. A light-sensitive photographic material free of light-sensitive heavy metal salts containing a light-insensitive silver salt selected from the group consisting of silver salt of a long-chain fatty acid, and a silver salt of aliphatic carboxylic acid containing a thioether group;

and the material contains a polymethine sensitizer in a spectrally sensitizing amount selected from those having the following formulae:

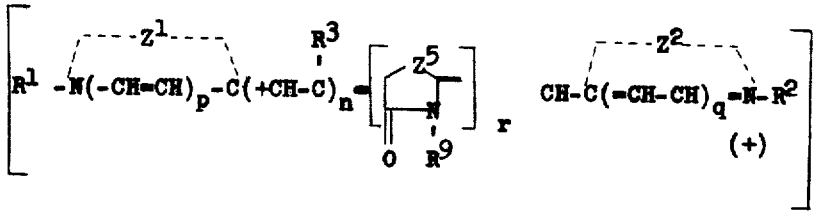

I

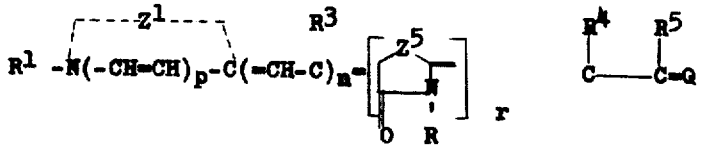

II

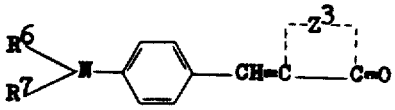

III

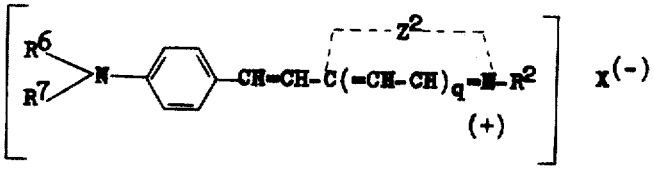

IV

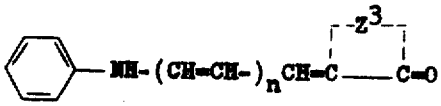

V

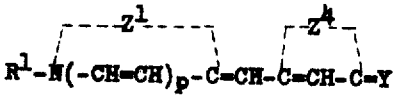

VI

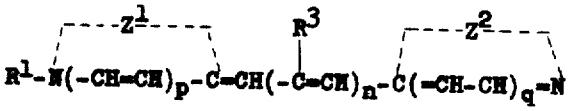

VII

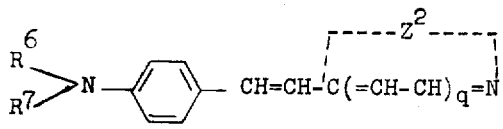

VIII in which $R^1$, $R^2$ = (1) a saturated or unsaturated aliphatic group; (2) cycloalkyl; (3) aryl or (4) alkoxy;

$R^3$ = hydrogen, phenol or a saturated aliphatic group;

$R^4$ = hydrogen, cyano, —CO—$R^8$,

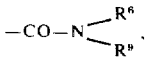

—$COOR^8$;

$R^5$ = $R^8$, $OR^8$,

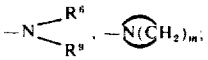

$R^4$ + $R^5$ together the ring members required for completing an isocyclic or heterocyclic ketomethylene ring;

$R^6$, $R^7$ = hydrogen or $R^8$;

$R^8$ = a saturated or olefinically unsaturated aliphatic group;

X(-) = an anion other than an anion capable of producing a light-sensitive silver metal salt with the non-light sensitive silver salt in the material;

*m G2* 4, 5, 6;

*n G2* 0, 1, 2;

*r*, *p*, *q*= 0, 1:

Q = O, S;

$R^9$ = hydrogen, $R^8$ or aryl;

$Z^1$, $Z^2$ = the members required for completing a 5- or 6-membered heterocyclic ring in which the heterocylcic group may contain a condensed benzene or naphthalene ring;

$Z^3$ = the ring members required for completing an isocyclic or heterocyclic ketomethylene ring;

$Z^4$ = the members required for completing a 5- or 6-membered isocyclic ring;

$Z^5$ = S, N—$R^9$;

Y = a radical of the following formulae:

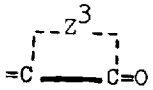

or

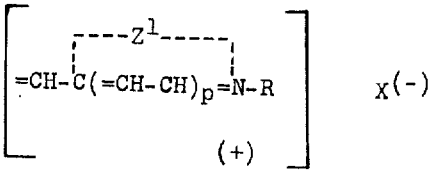

solely by said sensitizer, whereby the combination of the silver salt and said sensitizer is light-sensitive only in the spectral range of said sensitizer;

and a reducing agent having at least one active hydrogen atom attached to O, N or C, capable of reducing the silver salt in areas exposed to light and causes the development of a visible image in said material by reducing the silver salt when processed with heat after exposure whereby the said combination is sensitive to light in the absence of light-sensitive heavy metal salts.

in a proportion of 0.1 – 2 g of sensitizing dye per mol of the silver salt for spectrally sensitizing the silver salt

2. The photographic material of claim 1, wherein the light-insensitive silver salt is a silver salt of a long chain fatty acid.

3. The photographic material of claim 2, wherein the light-insensitive silver salt is silver behenate or silver stearate.

4. The photographic material of claim 1, wherein the light-insensitive silver salt is a silver salt of an aliphatic carboxylic acid which is substituted with a thioether group.

5. The photographic material of claim 1, wherein the reducing agent is a (1) phenol or naphthol which contains at least two phenolic hydroxyl groups which may be partly etherified with alkyl radicals containing up to 5 carbon atoms, (2) aminophenol or aminonaphthol which may be partly substituted with an acyl or carbamoyl group at the amino group or (3) an ortho-alkyl-substituted or cycloalkyl-substituted phenol.

6. The photographic material of claim 1, wherein the reducing agent is a compound based on pyrazolidin-3-one or pyrazolin-5-one.

7. The photographic material of claim 1, wherein the reducing agent is a hydroxylamine derivative.

8. The photographic material of claim 1, wherein the reducing agent is a compound of the o-hydroxy-chroman or 5-hydroxycoumaran series.

9. The photographic material of claim 1, which additionally contains light-insensitive heavy metal salts of uranium, cadmium or lead(II) compounds of organic acids and NH-acidic compounds or light-insensitive organic mercury(II) compounds.

10. The photographic material of claim 1, which additionally contains phthalimides or 2H-phthalazinone-(1).

11. The photographic material of claim 10, wherein the reducing agent is an o-alkyl- or o-cycloalkyl-substituted phenol.

12. The photographic material of claim 1, wherein $R^4$ and $R^5$ together represent the ring members necessary for completing a rhodanine, 2-thiohydantoin or 2-thiooxazolidine dione ring.

13. The photographic material of claim 1, wherein $Z^1$ and $Z^2$ represent the ring members necessary for completing a thiazoline, benzimidazole or benzoxazole ring.

14. The photographic material of claim 1, wherein the polymethine sensitizer is a hemioxonole with $Z^3$ representing the ring members necessary for completing a rhodanine ring.

* * * * *

UNITED STATES PATENT AND TRADEMARK OFFICE

CERTIFICATE OF CORRECTION

PATENT NO. : 3,933,507

DATED : January 20, 1976

INVENTOR(S) : von Konig et al

It is certified that error appears in the above-identified patent and that said Letters Patent are hereby corrected as shown below:

In formula I of claim 1, the left side should read --

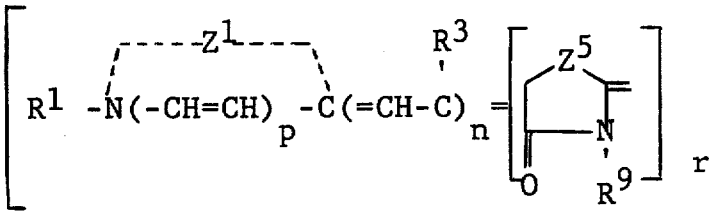

In formula II of claim 1, the left side should read --

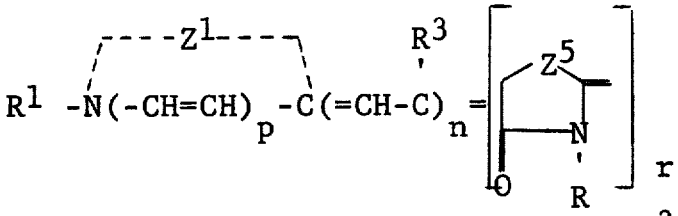

Column 63, line 11 in the definition of $R^3$, "phenol" should be -- phenyl -- .

Claim 1, in the second formula of the definition of Y, the formula should read --

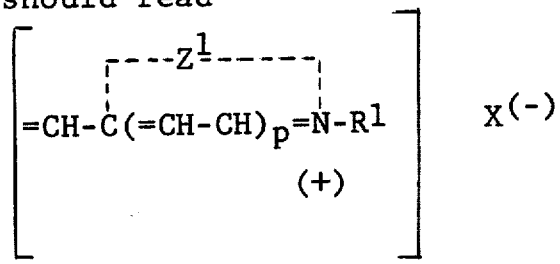

UNITED STATES PATENT AND TRADEMARK OFFICE

CERTIFICATE OF CORRECTION

PATENT NO. : 3,933,507

DATED : January 20, 1976

INVENTOR(S) : von Konig et al

It is certified that error appears in the above-identified patent and that said Letters Patent are hereby corrected as shown below:

Column 64, the first two lines "in a proportion of 0.1-2 g of sensitizing dye per mol of the silver salt for spectrally sensitizing the silver salt" should be deleted and reinserted in column 63, right after the formulae of the definition of Y, and before the word "solely" in claim 1.

Signed and Sealed this twenty-ninth Day of June 1976

[SEAL]

*Attest:*

RUTH C. MASON
*Attesting Officer*

C. MARSHALL DANN
*Commissioner of Patents and Trademarks*